US008515771B2

(12) United States Patent
Ejima

(10) Patent No.: US 8,515,771 B2
(45) Date of Patent: Aug. 20, 2013

(54) IDENTIFYING AN ENCODING FORMAT OF AN ENCODED VOICE SIGNAL

(75) Inventor: Naoki Ejima, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/408,726

(22) Filed: Feb. 29, 2012

(65) Prior Publication Data

US 2012/0226494 A1 Sep. 6, 2012

Related U.S. Application Data

(63) Continuation of application No. PCT/JP2010/003628, filed on May 31, 2010.

(30) Foreign Application Priority Data

Sep. 1, 2009 (JP) ..... 2009-202097

(51) Int. Cl.
*G10L 21/04* (2013.01)

(52) U.S. Cl.
USPC ..... 704/500; 704/229

(58) Field of Classification Search
USPC ..... 704/222, 230, 500–504, 229
See application file for complete search history.

(56) References Cited

U.S. PATENT DOCUMENTS 5,742,688 A 4/1998 Ogawa et al.
6,504,826 B1 1/2003 Kato et al.
7,693,183 B2 4/2010 Oh et al.
7,693,706 B2 4/2010 Oh et al.
7,702,407 B2 4/2010 Oh et al.
7,706,905 B2 4/2010 Oh et al.
7,761,177 B2 7/2010 Oh et al.
7,797,163 B2 9/2010 Pang et al.
7,987,097 B2 * 7/2011 Pang et al. ..... 704/500

(Continued)

FOREIGN PATENT DOCUMENTS

JP 05-191529 7/1993
JP 07-222297 8/1995

(Continued)

OTHER PUBLICATIONS

"ISO/IEC 13818-1 Second Edition, Information Technology—Generic Coding of Moving Pictures and Associated Audio Information: Systems", Dec. 1, 2000.

(Continued)

*Primary Examiner* — Abul Azad
(74) *Attorney, Agent, or Firm* — McDermott Will & Emery LLP

(57) ABSTRACT

A digital broadcast transmitting device is described that includes a packet generation unit configured to generate packetized elementary stream (PES) data by converting an inputted voice signal into an encoded voice signal and generating a voice stream packet including the encoded voice signal; a descriptor updating unit configured to update a component descriptor to include a component type identification (ID) and a change reservation ID, the component type ID indicating an encoding format of the encoded voice signal is MPEG surround format and the change reservation ID indicating a change of a format of the encoded voice signal to the MPEG surround format; a packetizing unit configured to generate section data by packetizing the component descriptor; a multiplexing unit configured to multiplex the PES data and the section data; and a modulation unit configured to modulate and transmit multiplexed data acquired from the multiplexing unit.

10 Claims, 28 Drawing Sheets

(56) References Cited

U.S. PATENT DOCUMENTS

| | | | | |
|---|---|---|---|---|
| 8,090,586 | B2 | 1/2012 | Oh et al. | |
| 8,131,134 | B2 * | 3/2012 | Sirivara et al. | 386/326 |
| 8,185,403 | B2 * | 5/2012 | Pang et al. | 704/500 |
| 2005/0099994 | A1 | 5/2005 | Kato et al. | |
| 2008/0219475 | A1 | 9/2008 | Oh et al. | |
| 2008/0221907 | A1 | 9/2008 | Pang et al. | |
| 2008/0228475 | A1 | 9/2008 | Oh et al. | |
| 2008/0228499 | A1 | 9/2008 | Oh et al. | |
| 2008/0228501 | A1 | 9/2008 | Pang et al. | |
| 2008/0235006 | A1 | 9/2008 | Pang et al. | |
| 2008/0255857 | A1 | 10/2008 | Pang et al. | |
| 2008/0275711 | A1 | 11/2008 | Oh et al. | |
| 2008/0279388 | A1 | 11/2008 | Oh et al. | |
| 2008/0294444 | A1 | 11/2008 | Oh et al. | |
| 2008/0304513 | A1 | 12/2008 | Oh et al. | |
| 2008/0310640 | A1 | 12/2008 | Oh et al. | |
| 2008/0319765 | A1 | 12/2008 | Oh et al. | |
| 2009/0003611 | A1 | 1/2009 | Oh et al. | |
| 2009/0003635 | A1 | 1/2009 | Pang et al. | |
| 2009/0006105 | A1 | 1/2009 | Oh et al. | |
| 2009/0006106 | A1 | 1/2009 | Pang et al. | |
| 2009/0028344 | A1 | 1/2009 | Pang et al. | |
| 2009/0055196 | A1 | 2/2009 | Oh et al. | |
| 2009/0119110 | A1 | 5/2009 | Oh et al. | |
| 2009/0164227 | A1 | 6/2009 | Oh et al. | |
| 2009/0216541 | A1 | 8/2009 | Oh et al. | |
| 2009/0225991 | A1 | 9/2009 | Oh et al. | |
| 2009/0234656 | A1 | 9/2009 | Oh et al. | |
| 2009/0274308 | A1 | 11/2009 | Oh et al. | |
| 2009/0287494 | A1 | 11/2009 | Pang et al. | |
| 2010/0061466 | A1 | 3/2010 | Gozen et al. | |
| 2011/0178808 | A1 | 7/2011 | Pang et al. | |
| 2011/0182431 | A1 | 7/2011 | Pang et al. | |
| 2011/0196687 | A1 | 8/2011 | Pang et al. | |
| 2011/0246208 | A1 | 10/2011 | Pang et al. | |

FOREIGN PATENT DOCUMENTS

| | | |
|---|---|---|
| JP | 2000-138877 | 5/2000 |
| JP | 2001-036999 | 2/2001 |
| JP | 2006-065958 | 3/2006 |
| JP | 2007-310087 | 11/2007 |
| JP | 2008-286904 | 11/2008 |
| JP | 2008-542815 | 11/2008 |
| WO | WO 2006/126843 | 11/2006 |
| WO | WO 2006/126844 | 11/2006 |
| WO | WO 2006/126855 | 11/2006 |
| WO | WO 2006/126856 | 11/2006 |
| WO | WO 2006/126857 | 11/2006 |
| WO | WO 2006/126858 | 11/2006 |
| WO | WO 2006/126859 | 11/2006 |
| WO | WO 2007/013775 | 2/2007 |
| WO | WO 2007/013780 | 2/2007 |
| WO | WO 2007/013781 | 2/2007 |
| WO | WO 2007/013783 | 2/2007 |
| WO | WO 2007/013784 | 2/2007 |
| WO | WO 2007/032646 | 3/2007 |
| WO | WO 2007/032647 | 3/2007 |
| WO | WO 2007/032648 | 3/2007 |
| WO | WO 2007/032650 | 3/2007 |
| WO | WO 2007/083952 | 7/2007 |
| WO | WO 2007/083953 | 7/2007 |
| WO | WO 2007/083955 | 7/2007 |
| WO | WO 2007/083956 | 7/2007 |
| WO | WO 2007/083957 | 7/2007 |
| WO | WO 2007/083958 | 7/2007 |
| WO | WO 2007/083959 | 7/2007 |
| WO | WO 2007/083960 | 7/2007 |
| WO | WO 2007/114594 | 10/2007 |
| WO | WO 2007/114624 | 10/2007 |
| WO | WO 2008/117524 | 10/2008 |

OTHER PUBLICATIONS

"ISO/IEC 13818-7 Third Edition, Information Technology—Generic Coding of Moving Pictures and Associated Audio Information—Part 7: Advanced Audio Coding (AAC)", Oct. 15, 2004.

"ISO/IEC FDIS 23003-1, Information Technology—MPEG Audio Technologies—Part 1: MPEG Surround (Voting Terminates on: Jan. 13, 2007)". 2006.

"Service Information for Digital Broadcasting System, Arib Standard: ARIB STD-B10, version 4.8", Association of Radio Industries and Businesses, Apr. 26, 2010, with partial English translation.

"Video Coding, Audio Coding and Multiplexing Specifications for Digital Broadcasting, Arib Standard: ARIB STD-B32, Version 2.2", Association of Radio Industries and Businesses, Jul. 29, 2009, with partial English translation.

* cited by examiner

FIG. 4A

Component type addition

| Component type | Description | Contents |
|---|---|---|
| 0x11 | 1/0 mode (Single mono) + SBR | Single mono + SBR |
| 0x12 | 1/0 + 1/0 mode (Dual mono) + SBR | Dual mono + SBR |
| 0x13 | 2/0 mode (Stereo) + SBR | Stereo + SBR |
| 0x14 | 3/2 + LFE mode (MPEG surround) | 5. 1ch MPEG surround |
| 0x15 | 3/2 + LFE mode (MPEG surround) + SBR | 5. 1ch MPEG surround + SBR |

FIG. 4B

Component type addition (mode change reservation)

| Component type | Description |
|---|---|
| 0x16 | Mode change reservation (SBR) |
| 0x17 | Mode change reservation (MPEG surround) |
| 0x18 | Mode change reservation (MPEG surround + SBR) |
| 0x19 | Mode change reservation (Sampling frequency) |
| 0x1A | Mode change reservation (Sampling frequency) & (SBR) |
| 0x1B | Mode change reservation (Sampling frequency) & (MPEG surround) |
| 0x1C | Mode change reservation (Sampling frequency) & (MPEG surround + SBR) |

900

FIG. 13 Priot Art

Component type ID addition (ARIB STD-B10)

| Component type | Description |
|---|---|
| 0x00 | Reserve for future use |
| 0x01 | 1/0 mode (single mono) |
| 0x02 | 1/0 + 1/0 mode (dual mono) |
| 0x03 | 2/0 mode (stereo) |
| 0x04 | 2/1 mode |
| 0x05 | 3/0 mode |
| 0x06 | 2/2 mode |
| 0x07 | 3/1 mode |
| 0x08 | 3/2 mode |
| 0x09 | 3/2 + LFE mode |
| 0x0A – 0x3F | Reserve for future use |
| 0x40 | Voice comment for visually disabled |
| 0x41 | Voice for visually disabled |
| 0x42 – 0xAF | Reserve for future use |
| 0xB0 – 0xFE | Business operator definition |
| 0xFF | Reserve for future use |

FIG. 14 Priot Art
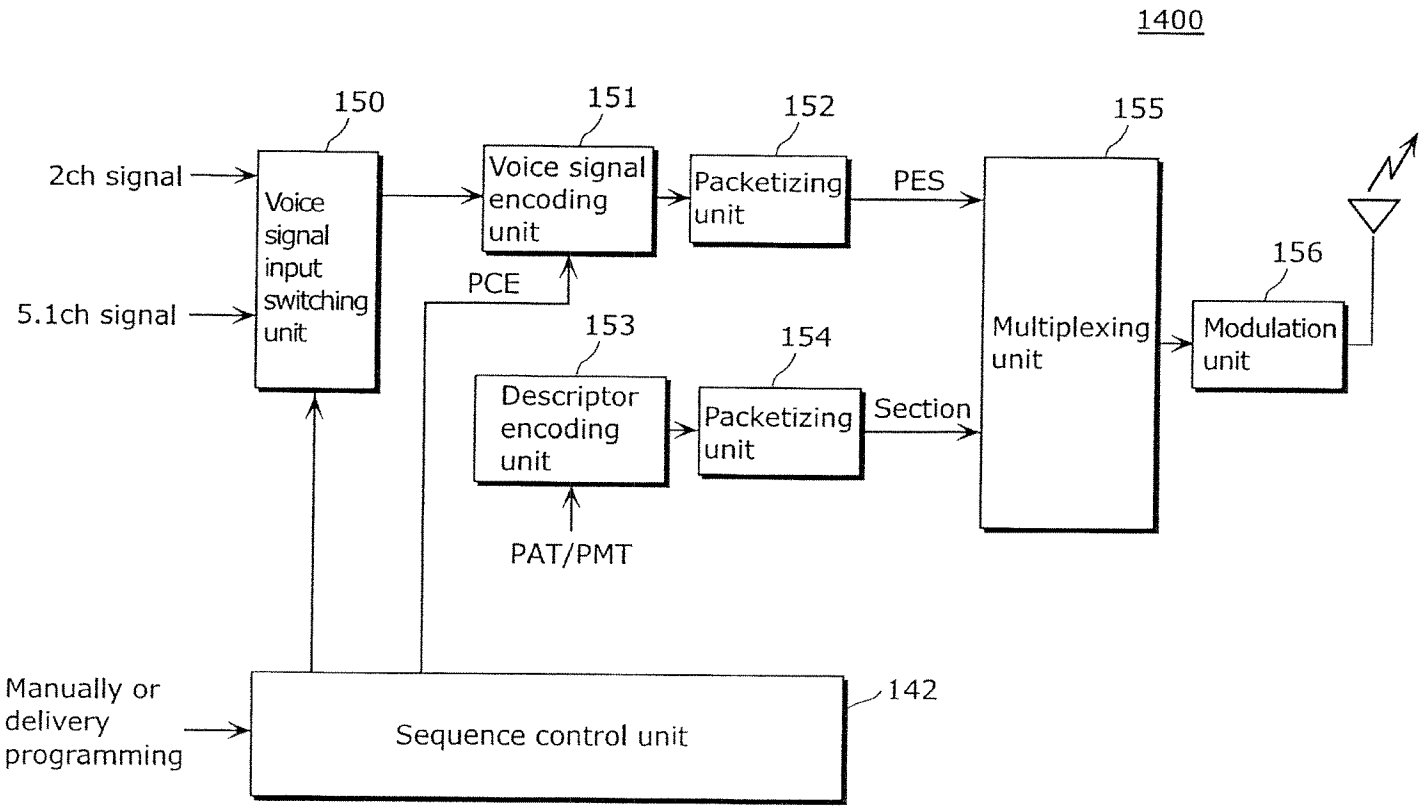

FIG. 15 Priot Art
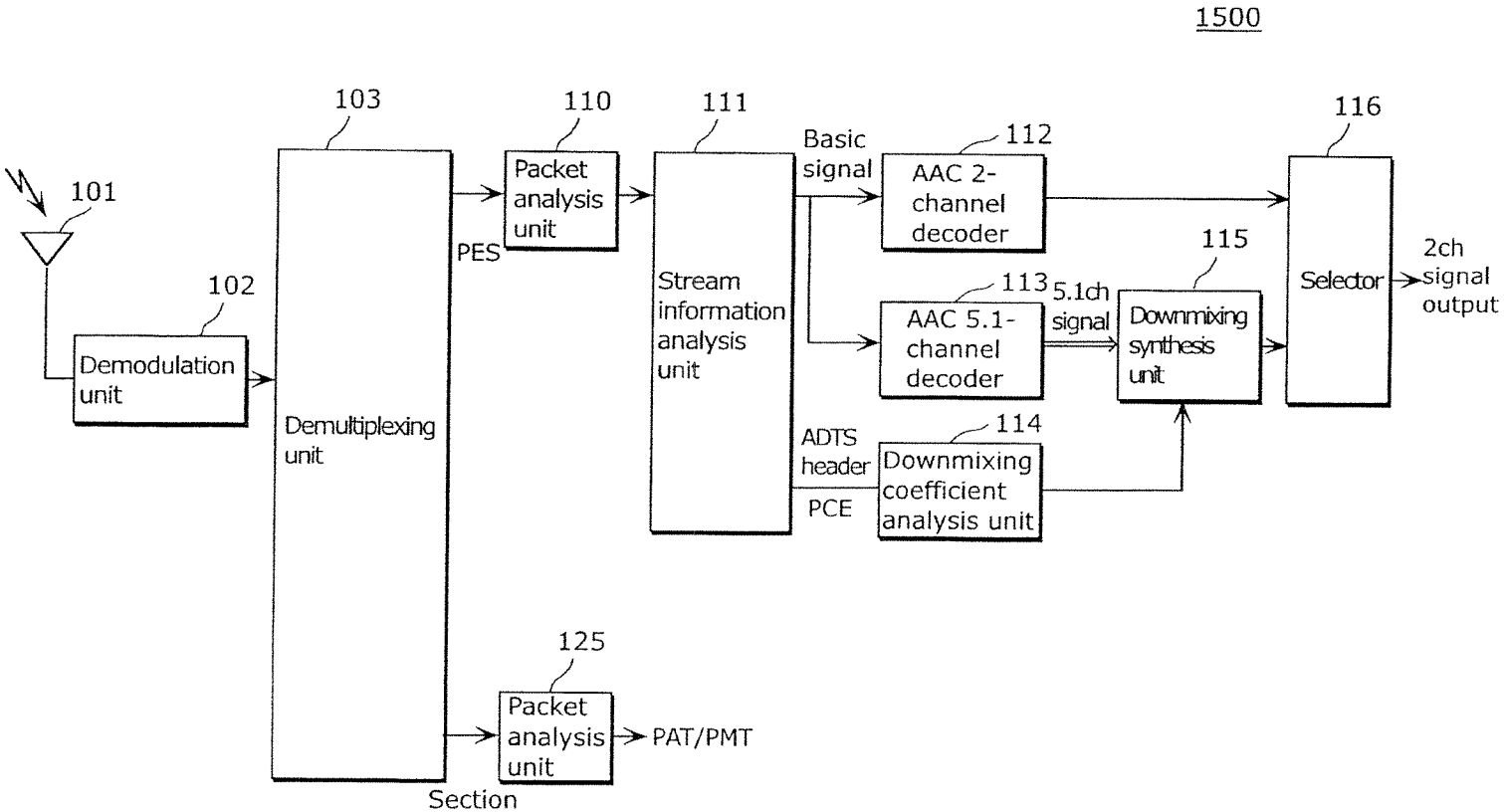

FIG. 16A Priot Art
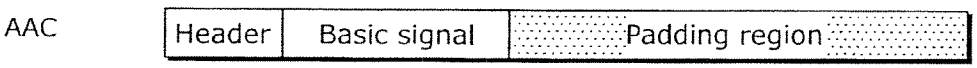

FIG. 16B Priot Art
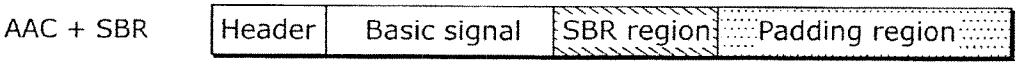

FIG. 16C Priot Art
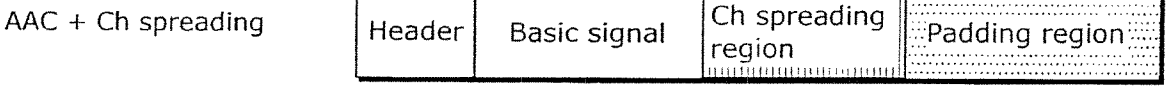

FIG. 16D Priot Art
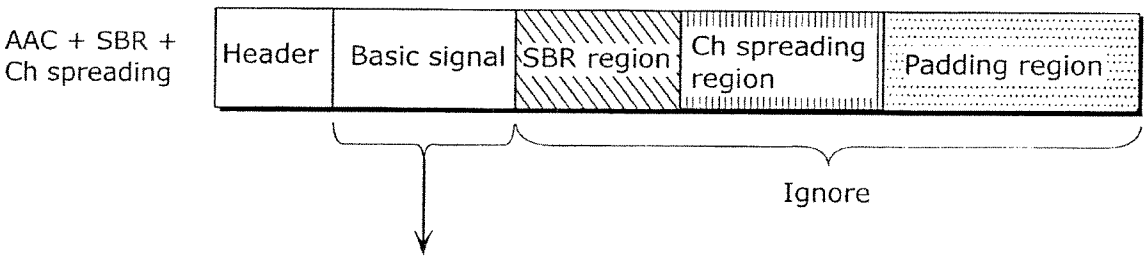

FIG. 16E Priot Art
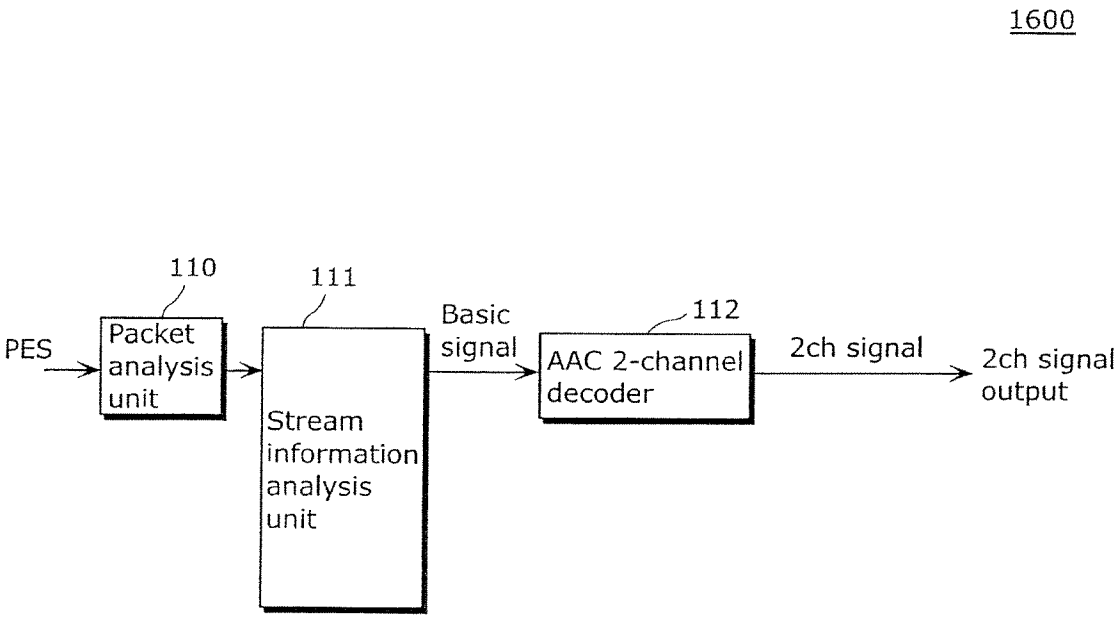

FIG. 17 Priot Art

| Receiver | Broadcast contents | Decoding processing | Decoding ch |
|---|---|---|---|
| 2ch reproduction | (a) 2chAAC | Basic signal | 2ch |
| | (b) 2chAAC + SBR | Basic signal + SBR region | 2ch |
| | (c) 2chAAC + Ch spreading (MPEG surround) | Only basic signal (Ch spreading region is ignored) | 2ch |
| | (c) 2chAAC + SBR + Ch spreading (MPEG surround + SBR) | Basic signal + SBR region (Ch spreading region is ignored) | 2ch |
| 5.1ch reproduction | (a) 2chAAC | Basic signal | 2ch |
| | (b) 2chAAC + SBR | Basic signal + SBR region | 2ch |
| | (c) 2chAAC + Ch spreading (MPEG surround) | Basic signal + Ch spreading region | 5.1ch |
| | (c) 2chAAC + SBR + Ch spreading (MPEG surround + SBR) | Basic signal + SBR region + Ch spreading region | 5. 1ch |

FIG. 18 Priot Art
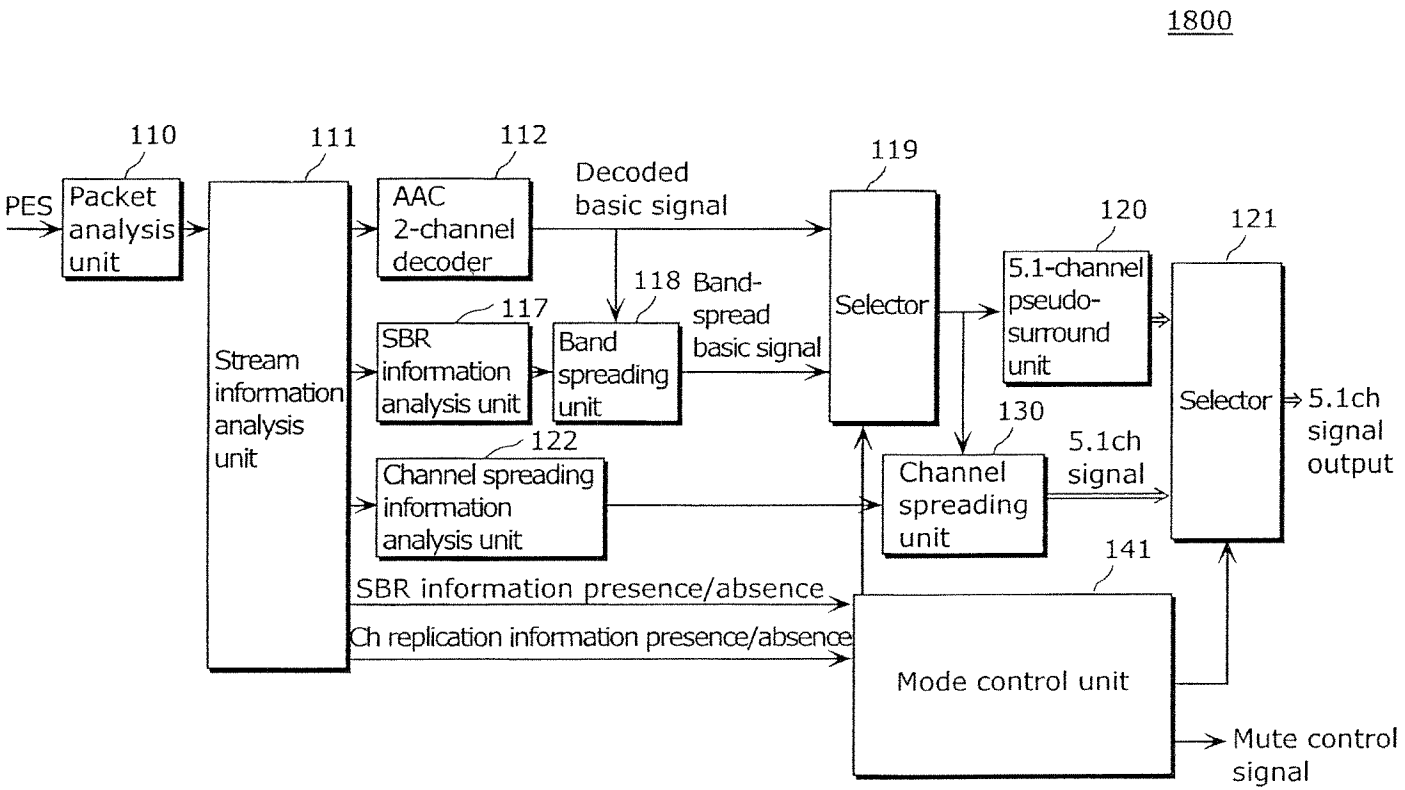

FIG. 19 Priot Art
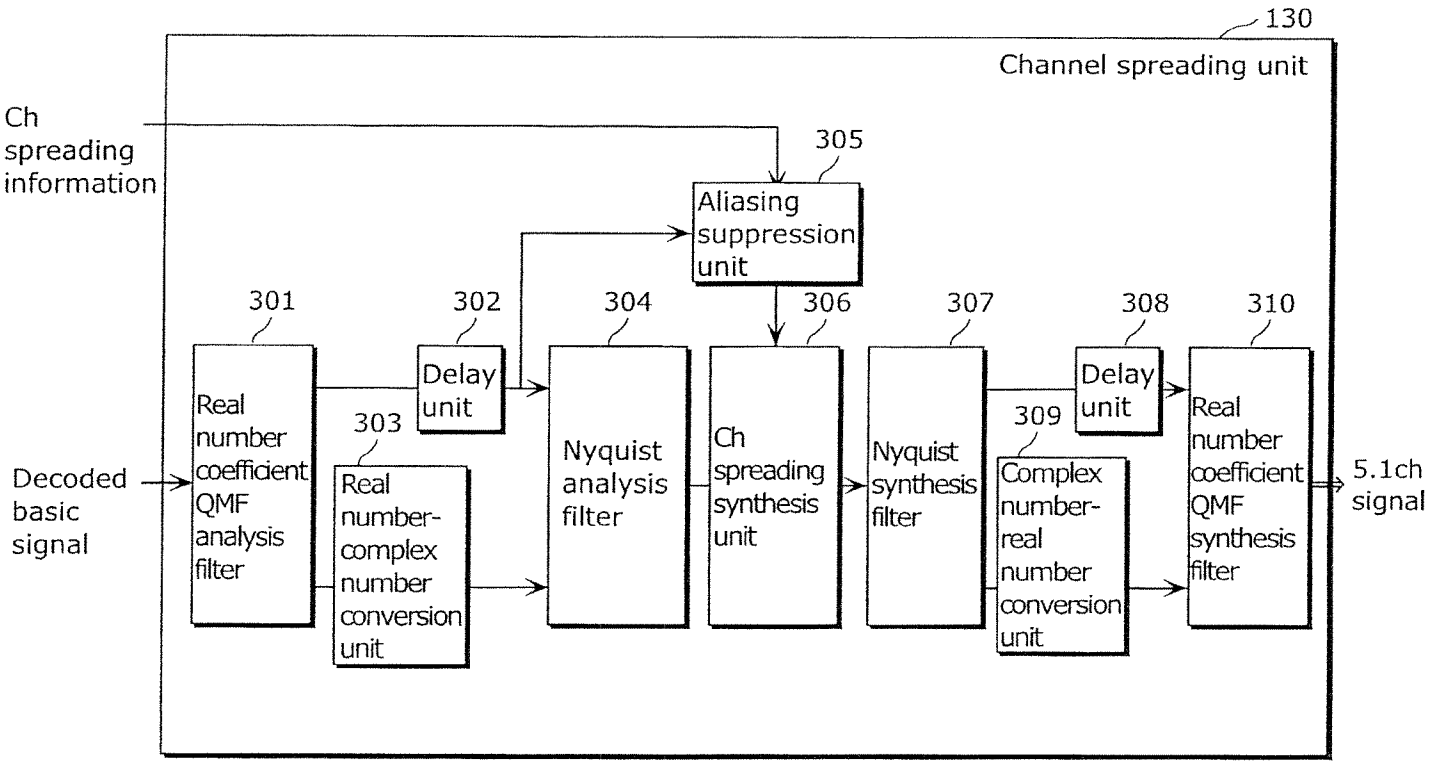

FIG. 20 Priot Art
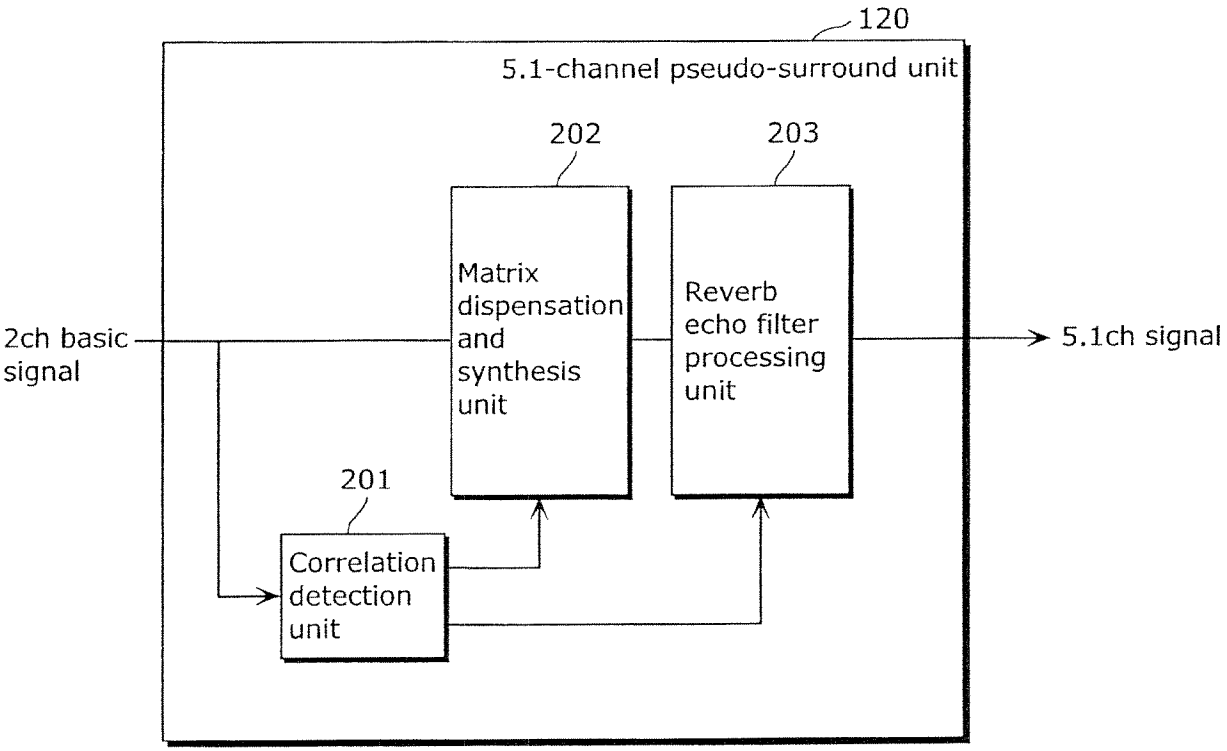

FIG. 21 Priot Art
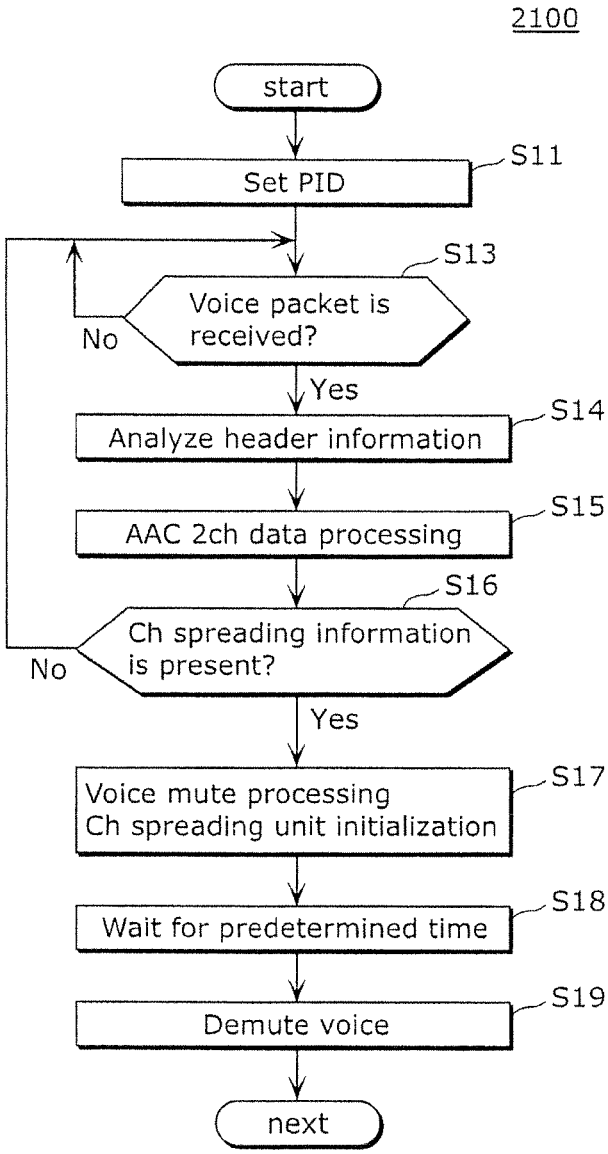

FIG. 22 Priot Art
2200
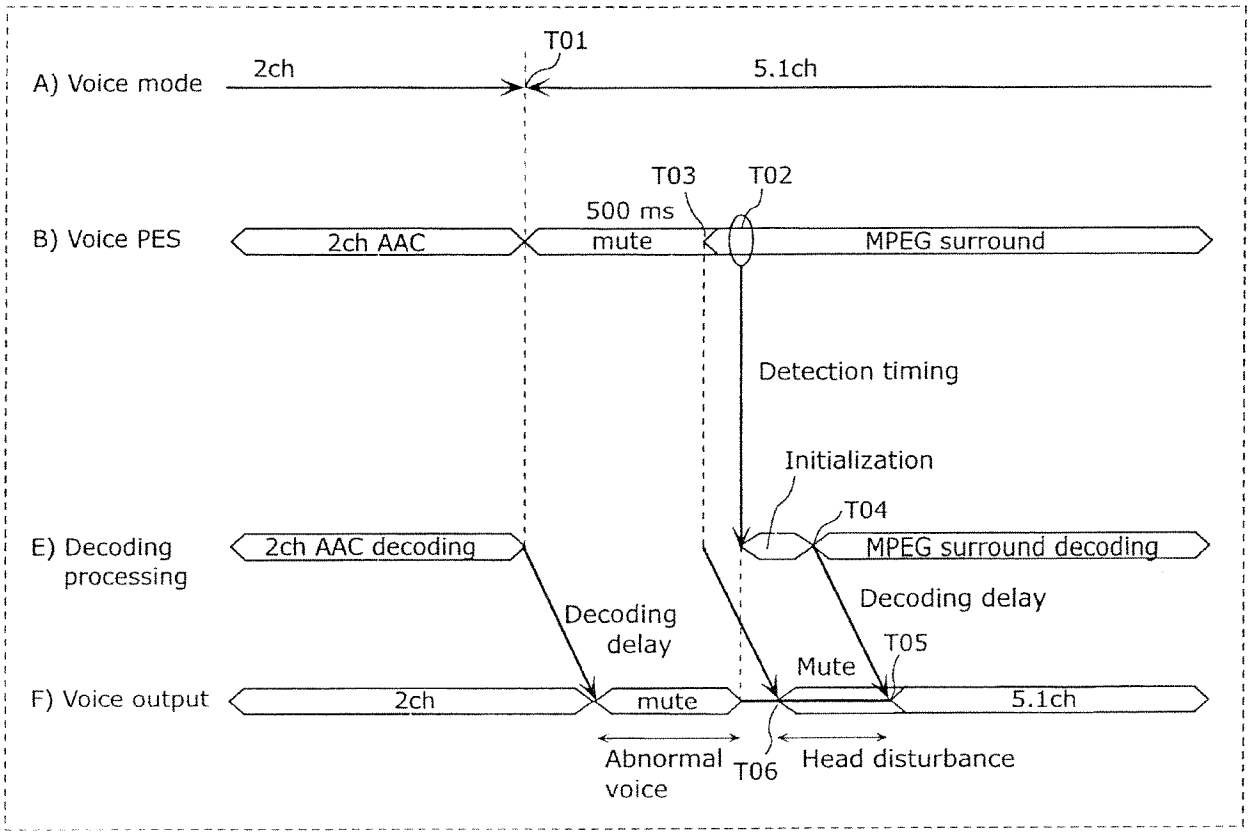

FIG. 23 Priot Art
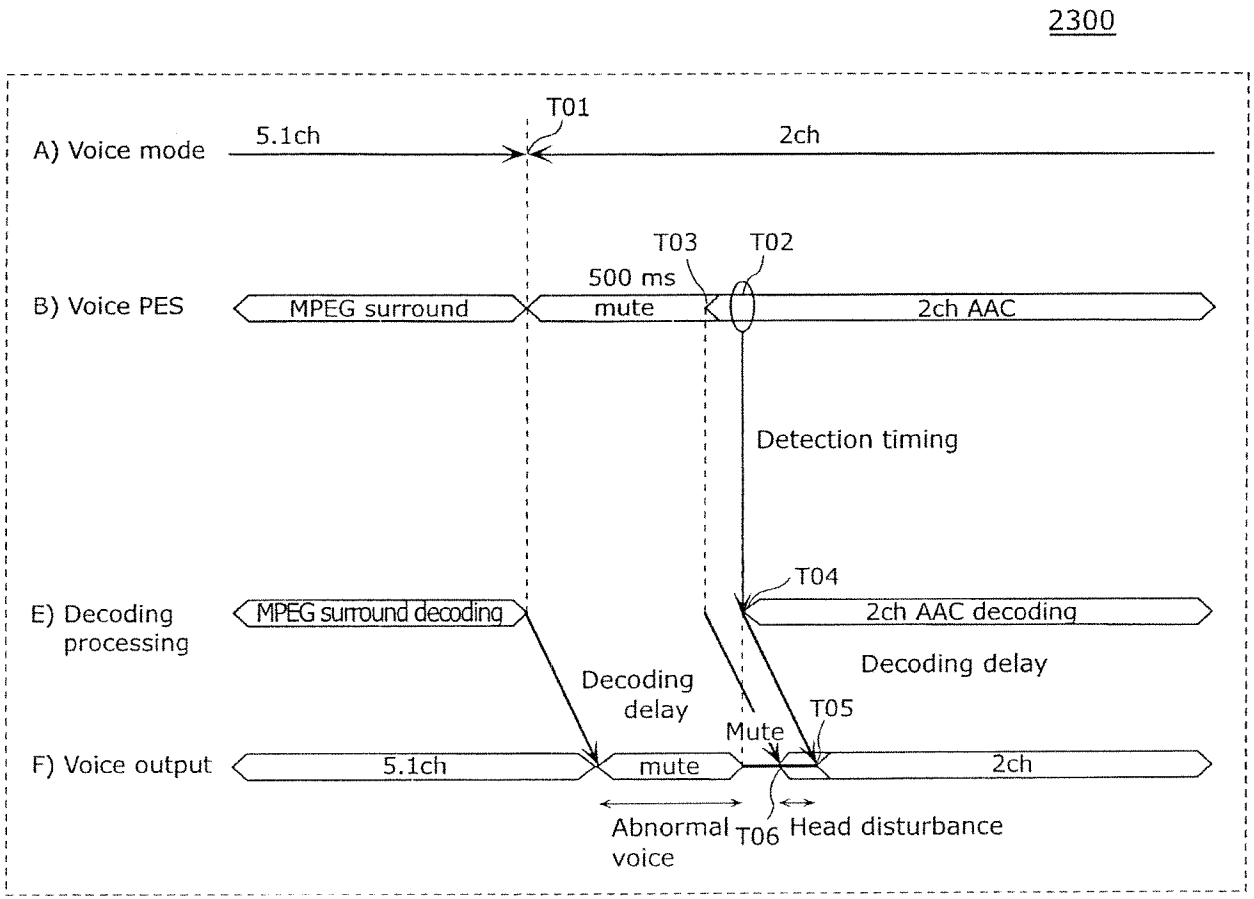

IDENTIFYING AN ENCODING FORMAT OF AN ENCODED VOICE SIGNAL

CROSS REFERENCE TO RELATED APPLICATION(S)

This is a continuation application of PCT Patent Application No. PCT/JP2010/003628 filed on May 31, 2010, designating the United States of America, which is based on and claims priority of Japanese Patent Application No. 2009-202097 filed on Sep. 1, 2009. The entire disclosures of the above-identified applications, including the specifications, drawings and claims are incorporated herein by reference in their entirety.

TECHNICAL FIELD

The instant application relates to a digital broadcast transfer system for transferring at least voice information in a digital system via a transfer path including ground waves or satellite waves. The digital broadcast transfer system includes a digital broadcast transmitting device and a digital broadcast receiving device.

BACKGROUND

In recent years, digital broadcasts that transfer information such as a voice, a picture, a character, or the like as a digital signal via a transfer path including ground waves or satellite waves have been further developed. One method for transferring a digital signal is a suggested by ISO/IEC13818-1. The ISO/IEC13818-1 describes a method for multiplexing and transferring an encoded digital signal including voice, picture, and piece of data of a program on a transmission side and receiving and reproducing of a specified program on a reception side.

The encoded voice signal and picture signal are divided by predetermined time and are provided with header information including, for example, reproduction time information, forming a packet called PES (Packetized Elementary Stream). The PES is basically divided in units of 184 bytes. The PES is additionally provided with header information including, for example, a packet identifier (PID), and is reconstructed to be a packet called a TSP (transport packet) to be multiplexed. Moreover, table information called PSI (Program Specific Information) indicating relationship between a program and a packet forming the program is multiplexed to the TSP of the voice signal or the picture signal. Defined as the PSI are four kinds of tables including a PAT (Program Association Table) and a PMT (Program Map Table). Described in the PAT is a PID of the PMT corresponding to each program, and described in the PMT is a PID of a packet in which, for example, a voice or picture signal forming the corresponding program is stored.

A receiver refers to the PAT and the PMT to thereby extract, from the TSP having a plurality of multiplexed programs, a packet forming a target program. The data packet and the PSI are stored into the TSP in a format called a section different from the PES. Extracting from the PES packet data excluding the header, etc. can provide, for example, an MPEG-2 AAC stream.

Before transferring a signal such as, for example, a voice signal to the receiving device, the signal may be encoded. As a method of encoding the voice signal, there is ISO/IEC 13818-7 (MPEG-2 Audio AAC). For the AAC standard used in the digital broadcast, the current service supports a 5.1 channel. For Japanese digital broadcasts, ARIB standards and operation specifications issued by Association of Radio Industries and Businesses are provided, which define in detail specifications of detailed methods, parameters, and operation.

FIG. 13 illustrates a table showing specified voice component types as defined by ARIB STD-B10. In a 2-channel stereo broadcast, a 2/0 mode (stereo) shown in this figure is typically used. In a surround broadcast, a 3/2+LFE mode is used to carry out a so-called 5.1-channel surround broadcast.

FIG. 14 illustrates a block diagram of a digital broadcast transmitting device 1400. The block diagram focuses on a function relating to switching between a 2-channel stereo broadcast and a surround broadcast. The digital broadcast transmitting device 1400 includes a sequence control unit 142, a voice signal input switching unit 150, a voice signal encoding unit 151, a packetizing unit 152, a descriptor encoding unit 153, a packetizing unit 154, a multiplexing unit 155, and a modulation unit 156.

An instruction for making switching manually or based on delivery programming is inputted to the sequence control unit 142. The sequence control unit 142, defining a switching point, controls the voice signal input switching unit 150 to switch an input signal from the 2-channel stereo to a 5.1-channel signal.

The voice signal encoding unit 151 encodes a signal in an MPEG-2 AAC system. For the 5.1 channel, the "3/2+LFE" is indicated by an MPEG-2 ADTS fixed header and also a downmixing coefficient is transferred by a PCE (Program Configuration Element). These information are contained in a voice signal stream.

FIG. 15 illustrates a receiving device 1500 for receiving the 5.1-channel surround broadcast. The receiving device 1500 includes an antenna 101, a demodulation unit 102, a demultiplexing unit 103, a packet analysis unit 110, a stream information analysis unit 111, an AAC 2-channel decoder 112, an AAC 5.1-channel decoder 113, a downmixing coefficient analysis unit 114, a downmixing synthesis unit 115, a packet analysis unit 125, and a selector 116.

Since voice reproduction of a typical TV receiver is usually performed through the 2-channel stereo, the receiving device 1500 is configured such that after once performing decoding processing on the 5.1 channel surround broadcast, downmixing to the 2-channel stereo signal is performed.

The demodulation unit 102 performs demodulation on broadcast waves received from the antenna 101 to reproduce a transport stream. The transport stream is forwarded to the demultiplexing unit 103. The demultiplexing unit 103 performs segmentation on the transport stream and extracts PES data and Section data from the transport stream. The section data is analyzed in the packet analysis unit 125 to extract PAT/PMT, which is used as, for example, program information. The PES data is analyzed in the packet analysis unit 110 to extract the selected stream.

The stream analyzed and selected in the packet analysis unit 110 is further analyzed in the stream information analysis unit 111 to perform segmentation to an AAC header, a basic signal, and others. If the header includes an ID for the 2-channel stereo, the basic signal is subjected to decoding processing into a 2-channel stereo signal in the AAC 2-channel decoder 112 and forwarded to selector 116 to be output as the 2-channel stereo signal.

If the header includes an ID for the 5.1 channel surround, the basic signal is subjected to decoding processing into a 5.1-channel signal in the AAC 5.1-channel decoder 113. The decoded 5.1 channel signal is then downmixed from the 5.1 channel to the 2 channel in the downmixing synthesis unit 115. A downmixing coefficient required for the downmixing at the downmixing synthesis unit 115 may be retrieved from the PCE of a stream header is used. The 2-channel stereo signal subjected to the decoding processing and downmixing in is selected by the selector 116 and outputted as a 2-channel stereo signal.

As noted above, to reproduce the 5.1 channel signal, the receiving device 1500 first performs decoding on the 5.1 channel and then performs downmixing to convert the decoded 5.1 channel signal into a 2-channel signal. As a result, the receiving device 1500 may increase the processing volume and may reduce power saving.

Therefore, there is a need for a system that allows multi-channel reproduction and reduces the delay in reproducing the voice signal when the format of the voice signal changes from one channel to another (e.g., from 2-channel stereo to 5.1 channel surround signal).

SUMMARY

In one general aspect, the instant application describes a digital broadcast transmitting device that includes a packet generation unit configured to generate packetized elementary stream (PES) data by converting an inputted voice signal into an encoded voice signal and generating a voice stream packet including the encoded voice signal; a descriptor updating unit configured to update a component descriptor to include a component type identification (ID) and a change reservation ID, the component type ID indicating an encoding format of the encoded voice signal is MPEG surround format and the change reservation ID indicating a change of a format of the encoded voice signal to the MPEG surround format; a packetizing unit configured to generate section data by packetizing the component descriptor; a multiplexing unit configured to multiplex the PES data and the section data; and a modulation unit configured to modulate and transmit multiplexed data acquired from the multiplexing unit.

The above general aspect may include one or more of the following features. The digital broadcast transmitting device may further include a sequence control unit configured to determine a timing of the change of the format of the encoded voice signal and control the descriptor updating unit in a manner such that the change reservation ID is outputted at a time before the timing of the change of the format of the encoded voice signal. The sequence control unit may be configured to control the packet generation unit in a manner such that voice in a period during which the change reservation ID is outputted is put on mute. The sequence control unit may be configured to control the descriptor updating unit in a manner such that the descriptor updating unit outputs the change reservation ID 500 milliseconds to 1 millisecond before the timing of the change of the format of the encoded voice signal.

In another general aspect, the instant application describes a digital broadcast receiving device that includes a reception unit configured to receive multiplexed broadcast data; a first packet analysis unit configured to acquire, from PES data included in the multiplexed broadcast data, a voice stream packet including an encoded voice signal; and a second packet analysis unit configured to detect, from section data included in the multiplexed broadcast data, a component descriptor including a component type identification (ID) and a change reservation ID, the component type ID indicating an encoding format of the encoded voice signal is MPEG surround format and the change reservation ID indicating a change of a format of the encoded voice signal to the MPEG surround format.

The above general aspect may include one or more of the following features. The digital broadcast receiving device may include a mode control unit configured to output a mute control signal for muting a voice upon detection of the change reservation ID by the second packet analysis unit. The digital broadcast receiving device may be configured to detect the change reservation ID before change of the format of the encoded voice signal. The digital broadcast receiving device may be configured to detect the change reservation ID 500 milliseconds to 1 millisecond before the change of the format of the encoded voice signal.

In another general aspect, the instant application describes a broadcasting transmitting and receiving system that includes the above described digital broadcast transmitting and receiving devices.

In another general aspect, the instant application describes a digital broadcast transmitting method comprising steps of: generating packetized elementary stream (PES) data by converting an inputted voice signal into an encoded voice signal and generating a voice stream packet including the encoded voice signal; updating a component descriptor to include a component type identification (ID) and a change reservation ID, the component type ID indicating an encoding format of the encoded voice signal is MPEG surround format and the change reservation ID indicating a change of a format of the encoded voice signal to the MPEG surround format; generating section data by packetizing the component descriptor; multiplexing the PES data and the section data; and modulating and transmitting multiplexed data acquired from the multiplexing step.

The method may further include steps of: determining a timing of the change of the format of the encoded voice signal, and outputting the change reservation ID at a time before the timing of the change of the format of the encoded voice signal. The method may further include a step of muting voice in a period during which the change reservation ID is outputted. Outputting the change reservation ID may include outputting the change reservation ID 500 milliseconds to 1 millisecond before the timing of the change of the format of the encoded voice signal.

In another general aspect, the instant application describes an integrated circuit including a packet generation unit configured to generate packetized elementary stream (PES) data by converting an inputted voice signal into an encoded voice signal and generating a voice stream packet including the encoded voice signal; a descriptor updating unit configured to update a component descriptor to include a component type identification (ID) and a change reservation ID, the component type ID indicating an encoding format of the encoded voice signal is MPEG surround format and the change reservation ID indicating a change of a format of the encoded voice signal to the MPEG surround format; a packetizing unit configured to generate section data by packetizing the component descriptor; a multiplexing unit configured to multiplex the PES data and the section data; and a modulation unit configured to modulate and transmit multiplexed data acquired from the multiplexing unit.

In another general aspect, the instant application describes a digital broadcast receiving method comprising steps of: receiving a multiplexed broadcast data; acquiring, from PES data included in the multiplexed broadcast data, a voice stream packet including an encoded voice signal; and detecting, from section data included in the multiplexed broadcast data, a component descriptor including a component type identification (ID) and a change reservation ID, the component type ID indicating an encoding format of the encoded voice signal is MPEG surround format and the change reservation ID indicating a change of a format of the encoded voice signal to the MPEG surround format.

In another general aspect, the instant application describes an integrated circuit including a receiving unit configured to receive multiplexed broadcast data; a first packet analysis unit configured to acquire, from PES data included in the multiplexed broadcast data, a voice stream packet including an encoded voice signal; and a second packet analysis unit configured to detect, from section data included in the multiplexed broadcast data, a component descriptor including a component type identification (ID) and a change reservation ID, the component type ID indicating an encoding format of the encoded voice signal is MPEG surround format and the change reservation ID indicating a change of a format of the encoded voice signal to the MPEG surround format.

The teachings of the instant application can also be realized as programs causing a computer to execute each of the digital broadcast transmitting method and the digital broadcast receiving method described above. Each of these programs can also be realized as a recording medium in which the programs are recorded. Then the programs can also be distributed via a transfer medium such as the Internet or a recording medium such as a DVD.

With the digital broadcast transmitting device according the instant application, a digital broadcast receiving device that receives data transmitted from the digital broadcast transmitting device can shorten time required for determining the MPEG surround broadcast and can reliably perform the determination without waiting for stream analysis. Thus, the digital broadcast receiving device can provide effect of executing decoding processing switching and mute processing in short time, for example, even upon switching from an AAC 2-channel to a 5.1-channel mode.

The receiving device of the instant application can recognize the change in the encoding format of the voice signal in advance of the actual change. Therefore, the receiving device of the instant application can further forward timing of the decoding processing and the mute processing. Furthermore, mute time inserted at time of change for abnormal voice protection can by systematically shortened.

BRIEF DESCRIPTION OF THE DRAWINGS

FIG. 4A illustrates an exemplary table showing a list of component type IDs to be added to a voice component descriptor according to the instant application;

FIG. 4B illustrates an exemplary table showing a list of change reservation IDs to be added to a voice component descriptor according to the instant application;

FIG. 13 illustrates a table showing specified voice component types as defined by ARIB STD-B10;

FIG. 14 illustrates a block diagram of a digital broadcast transmitting device;

FIG. 15 illustrates a receiving device for receiving a 5.1-channel surround broadcast;

FIG. 16A illustrates a diagram showing a frame structure of a basic signal expressed by MPEG-2 AAC;

FIG. 16B illustrates a diagram showing a frame structure in which high frequency information expressed by an SBR system is added to a basic signal expressed by the MPEG-2 AAC;

FIG. 16C illustrates a diagram showing a frame structure of an MPEG surround in which channel spreading information is added to a basic signal expressed by the MPEG-2 AAC;

FIG. 16D illustrates a diagram showing a frame structure of an MPEG surround in which the high frequency information and the channel spreading information expressed by the SBR system are added to a basic signal expressed by the MPEG-2 AAC;

FIG. 16E illustrates a configuration of a device that extracts only an AAC 2-channel as a basic signal;

FIG. 17 illustrates a table showing a list of decoding processing of two different types of receivers: a 2-channel reproduction-only device described above and a 5.1-channel reproducing and receiving device;

FIG. 18 illustrates a block diagram of an exemplary 5.1-channel reproduction-only receiving device 1800. In FIG. 18, the PES data is analyzed in the packet analysis unit 110 to extract the selected stream;

FIG. 19 illustrates a block diagram of an exemplary channel spreading unit shown in FIG. 18;

FIG. 20 illustrates an exemplary 5.1-channel pseudo-surround unit shown in FIG. 18;

FIG. 21 illustrates a process for detecting a change in an encoding format of a voice signal and modifying the processing at a receiver accordingly;

FIG. 22 illustrates a timing diagram showing time sequences for various processes in a 5.1 channel receiver when an encoding format of a voice signal changes from a 2 ch to a 5.1 ch; and FIG. 23 illustrates a timing diagram showing sequences from a 5.1 ch to the 2 ch voice mode change in a 5.1-channel receiver.

DETAILED DESCRIPTION

Figure 1:
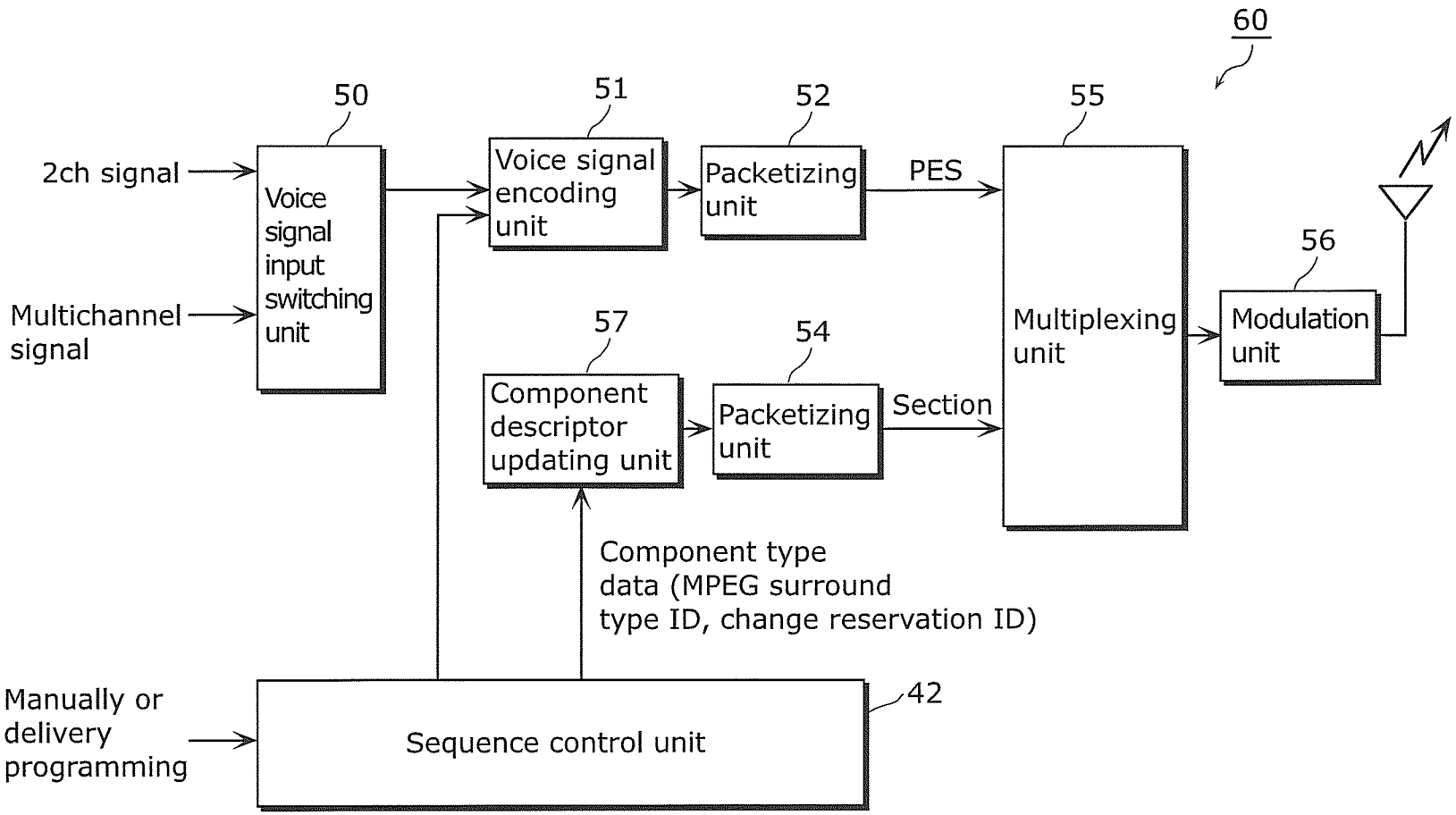
FIG. 1 illustrates an exemplary digital broadcast transmitting device according to the instant application.

Hereinafter, an implementation of the instant application will be described, with reference to the accompanying drawings. This implementation will be described, referring to as an example a digital broadcast transfer system using MPEG surround for a voice encoding system. This implementation is based on assumption that the MPEG standard is partially revised to perform addition for transferring a descriptor of new component type data. However, even in a case where the MPEG standard cannot be revised, since there is a region assigned as business operator regulation, this region can be newly defined by the ARIB standard. In this case, a range of standardization differs from that in the case where the MPEG standard is partially revised, but the same information transfer can be performed and the same effect can be provided in the both cases.

A system has been suggested which enables multichannel reproduction by defining as a basic signal a bit stream with a rate lowered through 2-channel downmixing and then adding additional information to the bit stream. For example, there is an MPEG surround system that allows 5.1-channel surround reproduction with approximately 96 kbps by adding information on a level difference and a phase difference between the channels to the basic signal obtained by downmixing from the multichannel to the 2 channel. This is a system standardized as ISO/IEC 23003-1.

The MPEG surround system is characterized in that a basic signal is a downmixing signal and thus it holds compatibility that permits reproduction on a conventional device without a problem and also the same level of sound quality can be realized at a lower rate than that of the AAC 5.1-channel. Thus, the MPEG surround system may be adopted as a system for allowing multichannel reproduction. Especially in, for example, a one-segment broadcast of a terrestrial digital TV mainly focusing on a low bit rate and a practical application test broadcast of a digital radio, it has been difficult or impossible to broadcast the AAC 5.1-channel due to an insufficient bit rate. However, the adoption of the MPEG surround system capable of transmission from approximately 96 kbps has made it possible to put a full-scale surround broadcast into practical use at the same level of bit rate as that of the one segment broadcast. Such MPEG surround system may also be suitable for a multimedia broadcast currently studied by use of a VHF band. In this case, it is possible to adopt the MPEG surround system in place of a conventional AAC 5.1-channel for the 5.1-channel surround broadcast.

FIGS. 16A-16D illustrate tables partially showing format configuration of AAC and AAC+SBR (Spectral Band Spreading). FIG. 16E illustrates a configuration of a device 1600 that extracts only an AAC 2-channel as a basic signal. In FIGS. 16C-16E, a "header" denotes an ADTS fixed header of the MPEC-2 AAC. Moreover, in the figures, "Ch" and "ch" are used as abbreviation of a channel. This also applies to the other figures.

Referring specifically to FIG. 16A, it illustrates a diagram showing a frame structure of a basic signal expressed by MPEG-2 AAC. FIG. 16B illustrates a diagram showing a frame structure in which high frequency information expressed by an SBR system is added to the basic signal expressed by the MPEG-2 AAC. FIG. 16C illustrates a diagram showing a frame structure of an MPEG surround in which channel spreading information is added to the basic signal expressed by the MPEG-2 AAC. FIG. 16D illustrates a diagram showing a frame structure of an MPEG surround in which the high frequency information and the channel spreading information expressed by the SBR system are added to the basic signal expressed by the MPEG-2 AAC.

In Japanese broadcasts, the 2 channel stereo of the MPEG-2 AAC is used as the basic signal. The AAC+SBR and the MPEG surround system as a spreading system of the MPEG-2 AAC both have a format structure in which spreading information is added onto the basic signal. A data string having these frame structures is transferred as a bursty stream. Between the systems shown in FIGS. 16A-16D, the header and the format configuration of the basic signal unit are common. In a frame structure of the MPEG-2 AAC, as in FIG. 16A, provided behind the basic signal is a padding region where, for example, null data is filled. Thus, for a decoder corresponding to the MPEG-2 AAC, even when a piece of the data of FIGS. 16A-16D has been inputted, the header and the basic signal unit have the common format configuration, and thus the basic signal unit of the MPEG-2 AAC has compatibility that permits at least reproduction.

Referring specifically to FIG. 16E, it illustrates a block diagram partially showing configuration of the device 1600 that extracts only the AAC 2 channel as the basic signal from received data. The device 1600 includes some of the same components as the device 1500 shown in FIG. 15. For the sake of clarity and brevity, these components in the device 1600 are provided with the same reference numerals and are not described here in more detail. An AAC 2-channel decoder 112 performs decoding processing on the basic signal of any of the signals shown in FIGS. 16A to 16D and reproduces and outputs the 2-channel stereo of the MPEG-2 AAC.

FIG. 17 illustrates a table showing a list of decoding processing of two different types of receivers: a 2-channel reproduction-only device described above and a 5.1-channel reproducing and receiving device. Assumed as the 2-channel reproducing-only device is a portable device which also supports SBR for high voice quality. Assumed as the 5.1-channel reproducing and receiving device is an in-vehicle tuner, and in a case where the 5.1-channel surround broadcast is received, a surround acoustic field can be enjoyed with at least (5+1) speakers. Moreover, in case of the 2-channel stereo broadcast, it can be enjoyed with conventional 2-channel stereo, but processing for the purpose of providing it as a pseudo-surround of the 5.1 channel may be added to use a common speaker unit.

FIG. 18 illustrates a block diagram of an exemplary 5.1-channel reproduction-only receiving device 1800. In FIG. 18, the PES data is analyzed in the packet analysis unit 110 to extract the selected stream. The selected stream is further analyzed in the stream information analysis unit 111 to perform segmentation. Specifically, the stream signal is segmented into a basic signal, SBR information, channel spreading information, SBR information presence/absence data, and channel spreading information presence/absence data.

The basic signal is outputted to the AAC 2-channel decoder 112, the SBR information is outputted to an SBR information analysis unit 117, and the channel spreading information is outputted to a channel spreading information analysis unit 122. Both the SBR information presence/absence data and the channel spreading information presence/absence data are outputted to a mode control unit 141.

A band spreading unit 118, based on the basic signal decoded by the AAC 2-channel decoder 112, copies a spectrum in a high range for band spreading. Moreover, the band spreading unit 118 performs control by use of output of the SBR information analysis unit 117 so that energy of an envelope becomes smooth on a frequency axis.

The channel spreading unit 130 performs channel spreading by use of output of the channel spreading information analysis unit 122 based on the basic signal to generate a 5.1-channel signal. The mode control unit 141 controls a selector 119 so as to select the band-spread basic signal in a case where the SBR information presence/absence data is present. Moreover, the mode control unit 141 controls a selector 121 so as to select the 5.1-channel signal in a case where the channel spreading information presence/absence data is present. The 2-channel signal of the selector 119 is converted into a pseudo-surround signal in the 5.1-channel pseudo-surround unit 120 and outputted to the selector 121. Such configuration is applied to, for example, an in-vehicle receiver.

FIG. 19 illustrates a block diagram of an exemplary channel spreading unit 130 shown in FIG. 18. The channel spreading unit 130 includes many filters and delay elements such as a real number coefficient QMF analysis filter 301, a Nyquist analysis filter 304, a Nyquist synthesis filter 307, a real number coefficient QMF synthesis filter 310, and delay units 302 and 308. Thus, processing time requires several tens of milliseconds to several hundreds of milliseconds. Furthermore, the channel spreading unit 130 includes real number-complex number conversion units 303 and 309, a channel spreading synthesis unit 306, and aliasing suppression unit 305.

FIG. 20 illustrates an exemplary 5.1-channel pseudo-surround unit 120 shown in FIG. 18. The 5.1-channel pseudo-surround unit 120 does not include side information in an inputted 2-channel basic signal, and thus a correlation detection unit 201 performs detection of correlation between the channels based on the 2-channel basic signal and controls a matrix dispensation and synthesis unit 202 and a reverb echo filter processing unit 203 to generate the 5.1-channel signal.

FIG. 21 illustrates a process 2100 for detecting a change in an encoding format of the voice signal and modifying the processing at a receiver accordingly. The process 2100 begins with the receiver setting PID to make settings related to channel tuning (Step S11). The receiver then determines whether a voice packed is received (Step S13). If not (Step S13, No), the receiver continues to monitor for reception of a voice packet. If it is determined that a voice packet is received (Step S13, Yes), the receiver analyzes the header information (Step S14). The header information is analyzed to determine a profile, a sampling frequency, etc. but discrimination between the 2 channel and the MPEG surround cannot be performed here yet. This is because the header information is the same for the 2-channel stereo and 5.1-channel surround system are the same as described above with respect to FIGS. 16A-16D.

The receiver performs AAC 2-channel data processing as the basic signal (Step S15). Then, the receiver determines whether or not the channel spreading information is present in a region following the basic signal (Step S16). This determination is based on a change from a result of the previous determination, and thus requires at least a period of a delivery cycle. Accuracy of reliable determination performed when an error is assumed increases in proportion to the number of times of repetition. If there is no change, the processing returns to Step S13. If there is a change, the receiver promptly performs voice mute processing and initialization of the channel spreading unit 130 (step S17). The receiver waits for a predetermined period of time in view of an appropriate margin for a period of time during which abnormal voice may be generated, and holds the mute (Step S18). Next, the receiver performs voice demuting (mute release) and outputs a reproduced signal (Step S19).

As described above, the MPEG surround system is advantageous for a 2-channel device because a 2-channel basic signal can be reproduced by ignoring a channel spreading portion. As such, the MPEG surround system may be suitable for portable devices. The MPEG surround system may be configured such that the basic signal and a header have the same configuration as that of a 2-channel AAC in order to avoid erroneous operation of the legacy 2-channel device. The difference therebetween may be the presence/absence of the channel spreading region in the MPEG surround system.

This structure may be beneficial for the 2-channel device that does not require format determination. However, such structure may not be beneficial for the 5.1-channel device because format determination cannot be achieved through header analysis even when the format determination is required immediately. Instead, in the 5.1-channel device determining whether or not the channel spreading information is in the region following the basic signal is repeatedly performed, which requires considerable time. An increase in detection time required for format determination can cause an abnormal voice to be generated at the start portion of the program.

FIG. 22 illustrates a timing diagram 2200 showing time sequences for various processes in the 5.1 channel receiver when the encoding format of the voice signal changes from a 2 ch to a 5.1 ch. In FIG. 22, A) denotes a change in a voice mode, and switching from the 2 channel mode to the 5.1 channel mode occurs at timing T01. In FIG. 22, B) denotes a change in a delivered voice PES. Up to the timing T01, data encoded by the 2-channel AAC is delivered, and data encoded by the MPEG surround is delivered thereafter. For Japanese digital broadcasts, the ARIB Standards ARIB STD-B32 defines that mute (no voice) is put for 500 ms at time of voice mode switching. Thus, mute data is consequently delivered during a period between the timing T01 and timing T03.

In FIG. 22, E) denotes timing of decoding processing performed by a receiver that receives such a signal. Since it requires a predetermined period of time for detecting whether or not there is a mode change and making determination, the receiver detects the presence/absence of the mode change at the timing T02, and then performs the voice mute processing and the initialization of the channel spreading unit 130 (corresponding to Step S17 of FIG. 21). In FIG. 22, F) denotes a change in voice output from the receiver. The receiver starts at timing T04 that is after passage of a predetermined period of time required for the decoder initialization, and obtains decoding processing data for the first time at timing T05 after passage of decoder delay time. Consequently, the mute can be released to output a reproduced voice.

On a broadcast delivery side, outputting of voice of the next program is started at timing T03 that is after passage of mute time at the time of switching. That is, the timing T03 serves as a head of the program. A point of head finding for reception and reproduction is from the timing T03 to timing T06 that passes through decoding delay.

A temporal position of the timing T02 varies depending on factors such as the fact that it requires time for determining presence/absence of a mode change with some level of broadcast wave reception. A delay of T02 as in the figure consequently delays the timing T05 behind the timing T06, which causes interruption of voice at a head of the program for a period of time corresponding to the delay. Specifically, the voice is interrupted between the timing T06 and the timing T05. Moreover, it is also assumed that even with a 500 ms portion where muting occurs, demute data turns into noise due to a reception error. Thus, there remains a risk of abnormal voice between the mode change detection on the reception side and mute start.

FIG. 23 illustrates a timing diagram 2300 showing sequences from a 5.1 ch to the 2 ch voice mode change in the 5.1-channel receiver. The timing diagram 2300 is similar to the timing diagram 2200 except that the mode change is from 5.1 ch to 2 ch. However, in timing diagram 2300, time required for initializing the channel spreading unit 130 is no longer required. As such, the delay in outing the voice of the 2-channel signal may be reduced.

Assuming that a newly developed MPEG surround system is adopted, it is possible to assume a mode of operation that permits coexistence of the MPEG surround system and the MPEG-2 AAC 2-channel system. For a multimedia broadcast, it is selected in units of time or units of program for broadcasting. For example, in a baseball live broadcast, the MPEG surround system is used to provide reality, and in a commercial broadcast put in the middle thereof, the typical AAC 2-hannel is used.

In this case, a problem may occur at time of switching. Since continuous voice output without interruption may be difficult to achieve, it is possible to expect some mute time. However, if the detection time for detecting the switching point is longer than the preset mute time, a starting portion of the program after switching may be interrupted. This in turn may cause an abnormal voice to be generated at the start portion of the program after the switching.

The instant application can reduce the time required for detecting the switching point (e.g., a point where the encoding format of the voice signal changes from a first format to a second format). To this end, the instant application describes a digital broadcast transmitting device, a digital broadcast receiving device, and a digital broadcast transmitting and receiving system capable of performing processing and determination in accordance with an encoding system of a voice signal transferred in a digital broadcast receiver.

FIG. 1 illustrates an exemplary digital broadcast transmitting device 60 according to the instant application. The digital broadcast transmitting device 60 may generate an encoding information packet for a voice signal, write into the generated encoding information packet type ID (e.g., component type ID) and change reservation ID information of the MPEG surround as component type data, and transfer the component type data together with the voice signal to the digital broadcast receiving device.

The digital broadcast transmitting device 60 includes a voice signal input switching unit 50, a voice signal encoding unit 51, a packetizing unit 52, a multiplexing unit 55, a sequence control unit 42, a component descriptor updating unit 57, a packetizing unit 54, and a modulation unit 56. The voice signal encoding unit 51 and the packetizing unit 52 realize processing performed by a packet generation unit in the digital broadcast transmitting device 60. Moreover, the packetizing unit 54 is one example of a packetizing unit in the digital broadcast transmitting device 60.

A 2-channel stereo or a 5.1-channel surround signal forming a program is inputted to the voice signal input switching unit 50, in which switching selection is made, and then is inputted to the voice signal encoding unit 51 to be converted into a digital signal. The digital signal obtained through the conversion is provided with header information and then is converted into a PES in the packetizing unit 52.

At the same time, the sequence control unit 42 controls the voice signal input switching unit 50 manually or based on a delivery programming instruction and also inputs the MPEG surround type ID and the change reservation ID as the component type data to the component descriptor updating unit 57. The component descriptor updating unit 57, based on the inputted component type data, updates the voice component descriptor to be outputted to the packetizing unit 54. The updated voice component descriptor includes the component type ID and the change reservation ID. Moving forward the "voice component descriptor" is expressed simply as "component descriptor" in some cases.

Data outputted from the component descriptor updating unit 57 is inputted with other PAT and PMT to the packetizing unit 54. The packetizing unit 54 packetizes these pieces of data in a section format. To this end, the component descriptor is packetized as encoding information in the section format separately from a PES packet of the voice signal and indicates to the receiving device whether the voice signal is encoded by the AAC or the MPEG surround. As a result, the receiving device of the instant application can recognize whether the encoding format of the voice signal is the AAC or the MPEG surround before the receiving device begins to decode the basic signal. Consequently, the receiving device of the instant application can reliably perform the decoding processing on the voice signal.

In contrast, the receiving device of the MPEG surround system described at the beginning of the detailed description of the instant application can first recognize whether the voice signal is encoded by the AAC or the MPEG surround after extracting one frame of basic signal from a plurality of packets and decoding the basic signal. Consequently, the receiving device of the MPEG surround system described at the beginning of the detailed description of the instant application may not reliably perform the decoding processing on the voice signal. For example, such receiving device may cause an abnormal voice to be generated at the start portion of the program after the switching.

Figure 2:
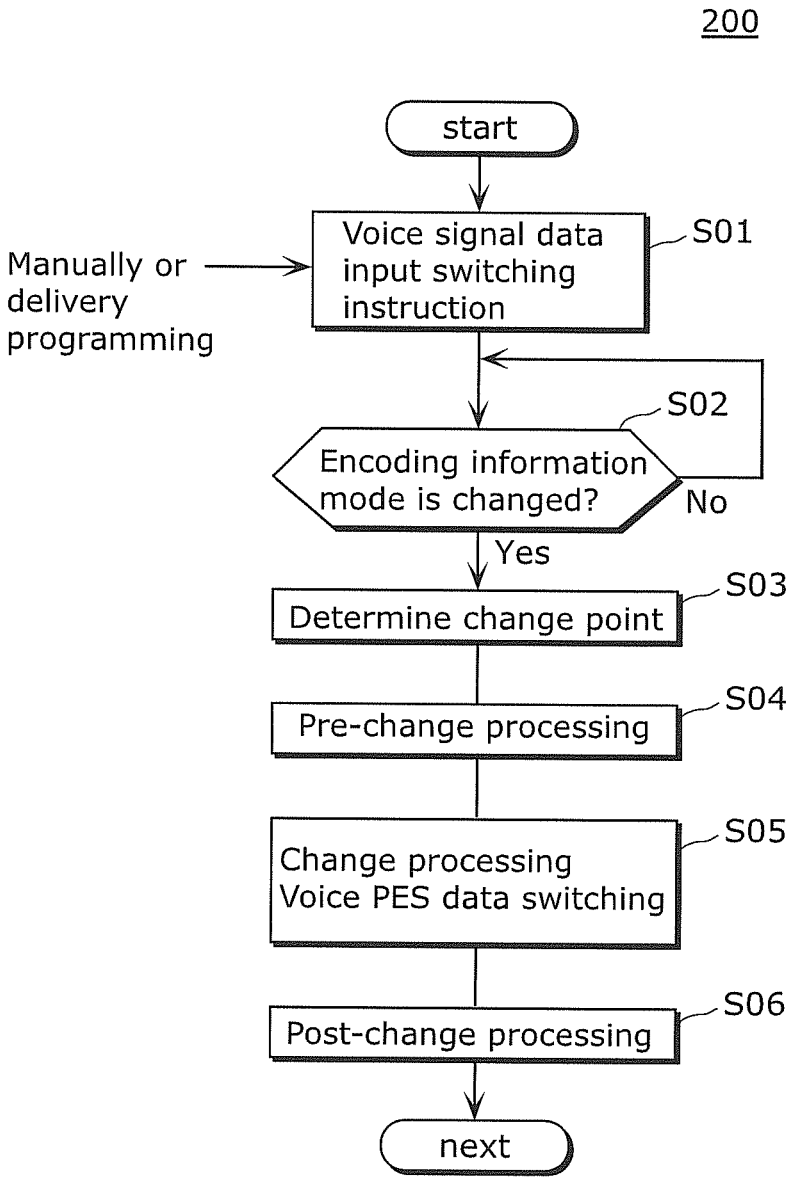
FIG. 2 illustrates an exemplary process for updating a component descriptor to include a change reservation ID.

FIG. 2 illustrates an exemplary process 200 for updating component descriptor to include a change reservation ID. The process 200 may be performed in the transmitting device 60 of the instant application. The process 200 begins with the transmitting device 60 receiving voice signal data input switching instruction (Step S01). The voice signal data input switching instruction may be inputted to the sequence control unit 42 manually or based on the delivery programming instruction. In response, the sequence control unit 42 determines whether or not an encoding information mode of the voice signal has been changed (Step S02). If not (Step S02, No), the sequence control unit 42 continues to monitor for a change in an encoding information mode of the voice signal. If the encoding information mode of the voice signal has been changed (Step S02, Yes), the sequence control unit 42 determines a change point (Step S03).

When the change point has been determined, the sequence control unit 42, as pre-change processing (Step S04), outputs a change reservation ID and also preferably controls the voice signal encoding unit 51 to thereby start processing such as suitable fade-out on the voice signal. After passage of predetermined time, the sequence control unit 42, as change processing (Step S05), controls the voice signal encoding unit 51 to thereby perform voice PES data switching. Then, the sequence control unit 42, as post-change processing (Step S06), stops delivery of the change reservation ID and also controls the voice signal encoding unit 51 to thereby perform suitable fade-in on the voice signal after the change and perform demute processing.

Figure 3:
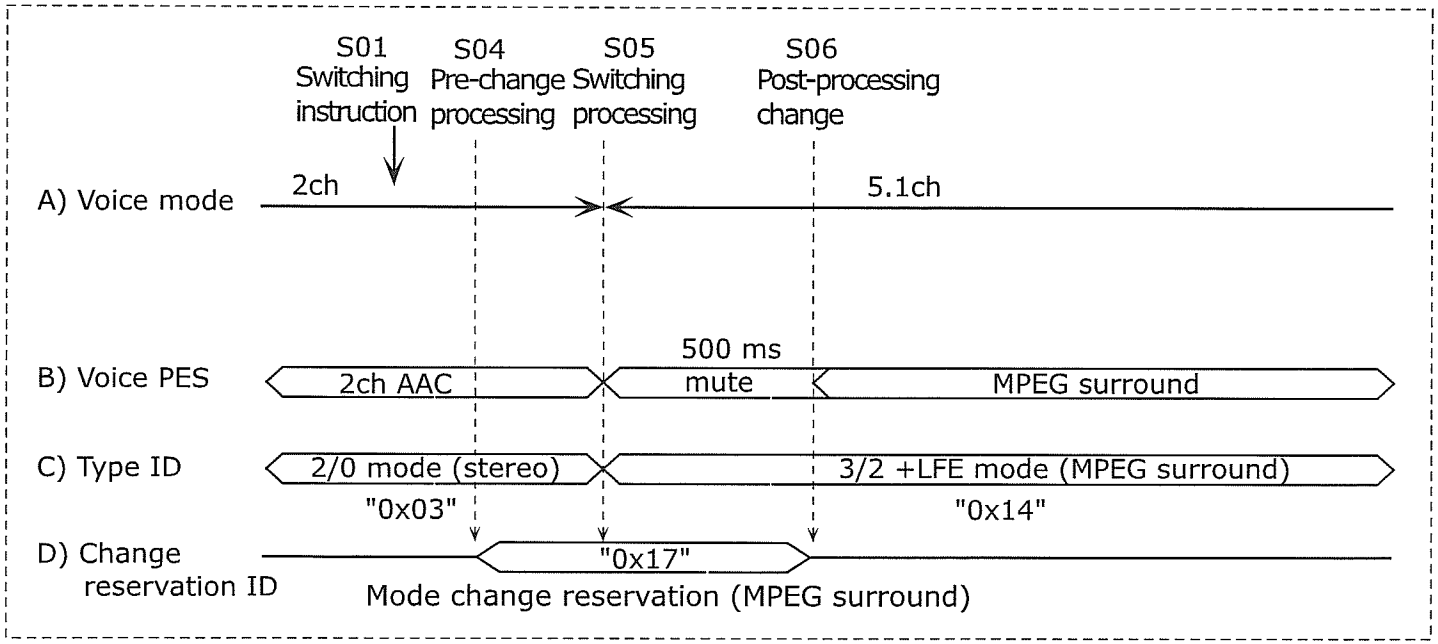
FIG. 3 illustrates a timing chart showing one example of voice output switching (from the 2 ch to the 5.1 ch) in the digital broadcast transmitting device shown in FIG. 1.

FIG. 3 illustrates a timing chart 300 showing one example of voice output switching (from the 2 ch to the 5.1 ch) in the digital broadcast transmitting device 60. In FIG. 3, A) denotes a voice mode of the voice signal, B) denotes an encoding format of the voice signal PES, C) denotes a component type ID of the voice component descriptor, and D) denotes a change reservation ID of the voice component descriptor. Steps S01, S04, S05, and S06 shown in FIG. 3 correspond to the steps shown in FIG. 2. Specifically, the sequence control unit 42, based on the switching instruction (Step S01), at the pre-change processing (Step S04), starts to deliver the change reservation ID "01x17." Additionally, the sequence control unit 42 switches the encoding mode while muting the voice PES at a point of the switching processing (Step S05), and at the same time, switches the component type ID. The component type ID is changed from 2/0 mode (stereo) to 3/2+LFE mode (MPEG surround).

Note that the change reservation ID is outputted at timing that is ahead of or behind the aforementioned change point by predetermined time. For example, the delivery of the change reservation ID is started at timing that is ahead of the change point by time corresponding to any of 500 milliseconds to 1 millisecond.

The sequence control unit 42 stops the change reservation ID at the post-change processing (Step S06) and releases voice mute. The change reservation ID "0x17" reflects the presence/absence of the MPEG surround changes. In one example, the change reservation ID "0x17" means that the 2-channel stereo is currently used, but a change to the 5.1-channel MPEG surround is to be made.

The change reservation ID "0x17" may also be used to reflect a change from the MPEG surround to the 2-channel stereo. In this scenario, the change reservation ID means that the 5.1 channel MPEG surround is currently being used, but a change to the 2-channel stereo is to be made.

The various component types of the voice component descriptor according to the current standard are shown in FIG. 13. As shown, under the current standard, the voice component descriptor does not include a component type that can identify the MPEG surround. Thus, in the instant application, the voice component descriptor is updated to include component type IDs, identifying the MPEG surround.

FIGS. 4A and 4B illustrate tables identifying lists of component type IDs and change reservation IDs to be added to the voice component description to enable identification of the MPEG surround and SBR. FIG. 4A illustrates an exemplary table showing a list of component type IDs to be added to the voice component descriptor according to the instant application. FIG. 4B illustrates an exemplary table showing a list of change reservation IDs to be added to the voice component descriptor according to the instant application. The change reservation ID is spread so that in addition to the MPEG surround change, other changes such as, for example, SBR change and sampling frequency change reservation can be made.

Figure 5:
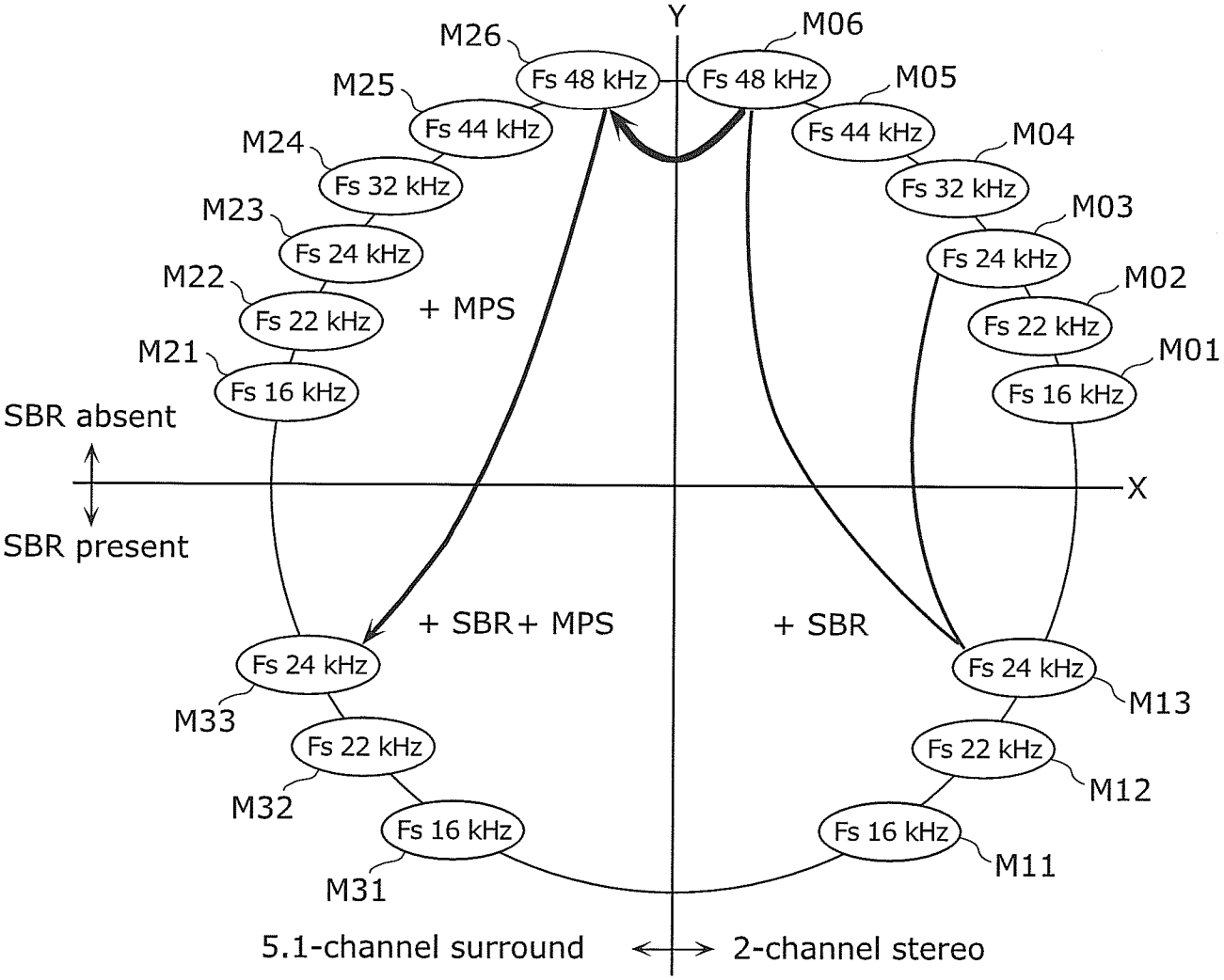
FIG. 5 illustrates a transition diagram showing various examples of the voice mode change.

FIG. 5 illustrates a transition diagram 500 showing various examples of the voice mode change. The transition diagram 500 includes a first quadrant, a second quadrant, a third quadrant, and a fourth quadrant. At the first quadrant of an XY plane, normal modes with sampling frequencies of 16 KHz through 48 KHz are arranged and illustrated. At the second quadrant, MPEG surround-provided modes are arranged and illustrated. At the fourth quadrant, SBR-provided modes are arranged and illustrated. At the third quadrant, SBR and MPEG surround-provided modes are arranged and illustrated.

For example, as shown by a bold line, transition occurs from the mode M03 (normal with a sampling frequency of 24 Hz) to the mode M13 where the SBR is added. Then, the SBR is stopped to achieve transition to the mode M06 where the sampling frequency is 48 kHz. From mode M06, transition to the mode M26 where the MPEG surround is added occurs, and then the SBR is further added to achieve transition to the mode M33. Making the additions shown in FIGS. 4A and 4B permits identifying the transitions described above with the voice component descriptor. Note in diagram 500 the sampling frequency is shown limited in the SBR-provided mode simply due to operation regulation of the standard.

As described above, the voice component descriptor spreading makes it possible to deliver multiplexed data with various component type IDs and change reservation IDs. As a result, the digital broadcast transmitting device 60 of the instant application can easily identify to the digital broadcast receiving device point in time the voice signal changes from one format to another. Next, a receiving device that receives a broadcast transmitted from the digital broadcast transmitting device 60 will be described.

Figure 6:
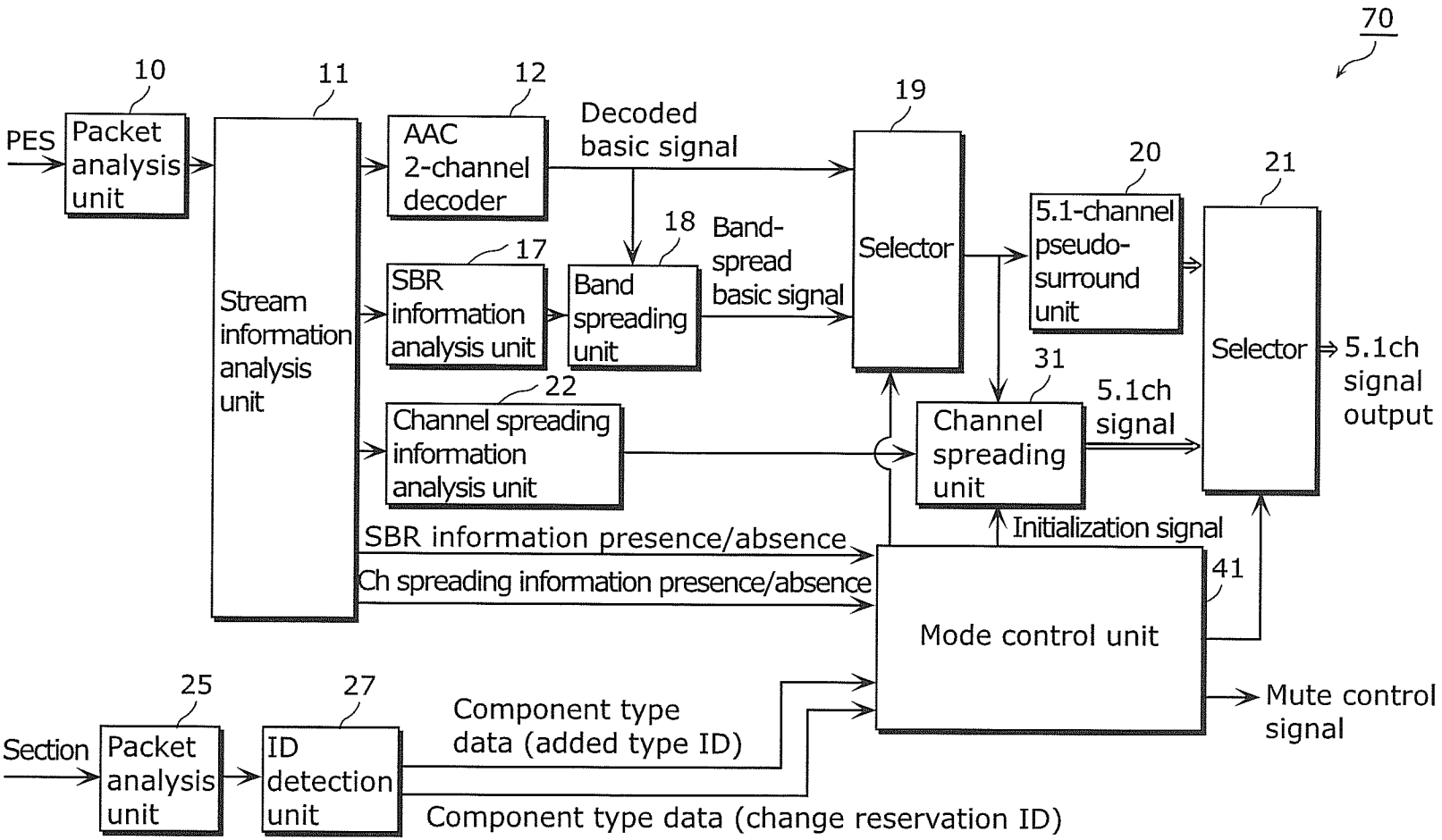
FIG. 6 illustrates an exemplary digital broadcast receiving device of the instant application.

FIG. 6 illustrates an exemplary digital broadcast receiving device 70 of the instant application. The digital broadcast receiving device 70 is configured to receive a broadcast of the digital broadcast transmitting device 60 and to reproduce a 5.1-channel signal. To this end, the digital broadcast receiving device 70 analyzes a section packet including encoding information (e.g., component type ID and change reservation ID) of the encoded voice signal and decodes the voice signal in accordance with an encoding format employed at time of encoding. Furthermore, by utilizing the encoding information, the digital broadcast receiving device 70 can smoothly decode the voice signal even when the encoding format of the video signal changes from one format to another at a switching point.

The digital broadcast receiving device 70 includes a packet analysis unit 10 that analyzes the PES data, a stream information analysis unit 11, an AAC 2-channel decoder 12, an SBR information analysis unit 17, a channel spreading information analysis unit 22, a band spreading unit 18, a selector 19, a channel spreading unit 31, a 5.1-channel pseudo-surround unit 20 that converts a 2 ch signal into a 5.1 ch pseudo-surround signal, a selector 21, a mode control unit 41, a packet analysis unit 25 that analyzes section data, and an ID detection unit 27. The digital broadcast receiving device 70 further includes an antenna, a demodulation unit, and a demultiplexing unit (not shown). These components were described with respect to the receiving device 1500 shown in FIG. 15. Therefore, for the sake of brevity, they are not described here.

The packet analysis unit 10 is one example of a first packet analysis unit in the digital broadcast receiving device of the instant application. The packet analysis unit 25 and the ID detection unit 27 may perform processing of a second packet analysis unit in the digital broadcast receiving device of the instant application. Digital broadcast waves received through the antenna are subjected to reception processing in the demodulation unit to output a multiplexed TSP string. In the demultiplexing unit, PES data and section data are outputted from the received TSP string.

The PES data is inputted to the packet analysis unit 10. The packet analysis unit 10 acquires from the PES data a voice stream packet including an encoded voice signal. The acquired voice stream packet is analyzed by the stream information analysis unit 11. The stream analysis unit 11 outputs a basic signal, SBR information, SBR information presence/absence data, and channel spreading information presence/absence data.

The basic signal is outputted to the AAC 2-channel decoder 12, the SBR information is outputted to the SBR information analysis unit 17, and the channel spreading information is outputted to the channel spreading information analysis unit 22. The SBR information presence/absence data and the channel spreading presence/absence data are both outputted to the mode control unit 41.

The band spreading unit 18, based on the basic signal decoded in the AAC 2-channel decoder 12, copies a spectrum in a high range to achieve band spreading. Moreover, the band spreading unit 18 performs control so that energy of an envelope smoothened by use of the output of the SBR information analysis unit 17. The channel spreading unit 31, based on at least the basic signal, performs channel spreading by use of output of the channel spreading information analysis unit 22 to generate a 5.1-channel signal.

After the encoding information is extracted from the section data in the packet analysis unit 25, the encoding information is inputted to the ID detection unit 27. The ID detection unit 27 detects an added component type ID and change reservation ID, which are then inputted to the mode control unit 41.

Included as contents of the added component type ID and change reservation ID are type IDs corresponding to the SBR information presence/absence data and the channel spreading information presence/absence data, and thus their information are consequently acquired together with results of the stream information analysis unit 11. However, acquisition time may differ. In another implementation, the mode control unit 41 is provided with the component type ID and the change reservation ID and not with the SBR information presence/absence data and the channel spreading presence/absence data.

In either case, based on these pieces of information, the mode control unit 41 controls the selector 19 so that the band-spread basic signal is selected in a case where the voice signal is SBR-provided. Moreover, the mode control unit 41 controls the selector 21 so that the 5.1-channel signal is selected in a case where the voice signal is MPEG surround-provided.

In the receiving device 70, the change reservation ID can be detected before the timing of the change of the format of the encoded voice signal. As a result, a mute control signal for previously and gradually muting the voice in a fade-out manner to achieve muting can be outputted from the mode control unit 41 to a voice output unit (not shown). Moreover, at the same time, the change reservation ID is outputted as a signal for the initialization of the channel spreading unit 31. That is, the change reservation ID is also used for speeding up processing performed upon proceeding to a channel spreading mode of the MPEG surround.

Figure 7:
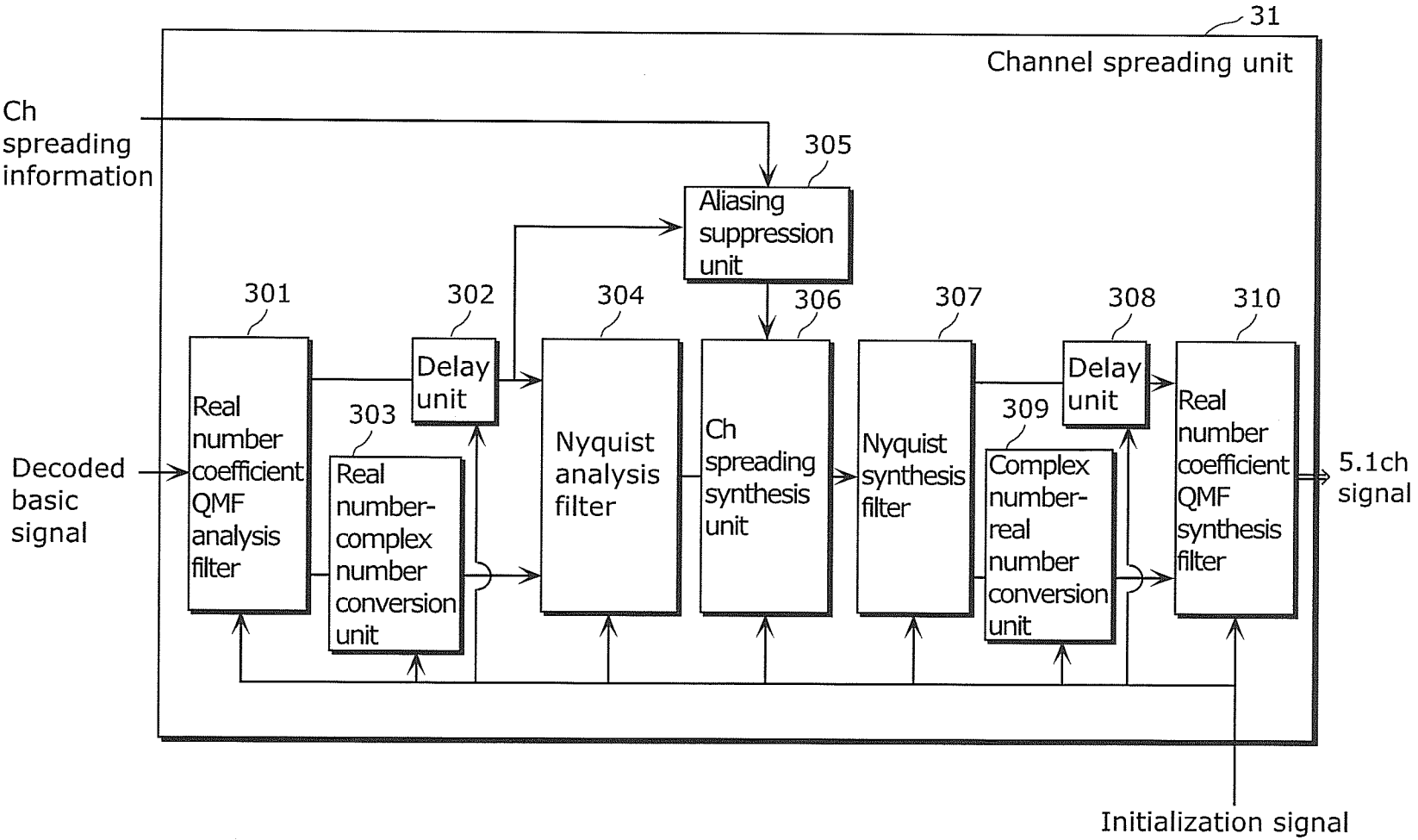
FIG. 7 illustrates in more detail the configuration of the channel spreading unit of the receiving device shown in FIG. 6.

FIG. 7 illustrates in more detail the configuration of the channel spreading unit 31 of the receiving device 70 shown in FIG. 6. The functional configuration of the channel spreading unit 31 is the same as functional configuration of the channel spreading unit 130 shown in FIG. 18. Therefore, for the sake of brevity, the functional configuration of the channel spreading unit 31 is not described here in more detail. The channel spreading unit 31 is different from the channel spreading unit 130 in that the channel spreading unit 31 is configured such that an initial signal is provided to each filter and each delay unit. This can prevent generation of abnormal voice due to remaining waste data, which therefore no longer requires a sequence such as application of, for example, zero data. This provides effect that the channel spreading processing can be started immediately after new data is acquired.

Figure 8:
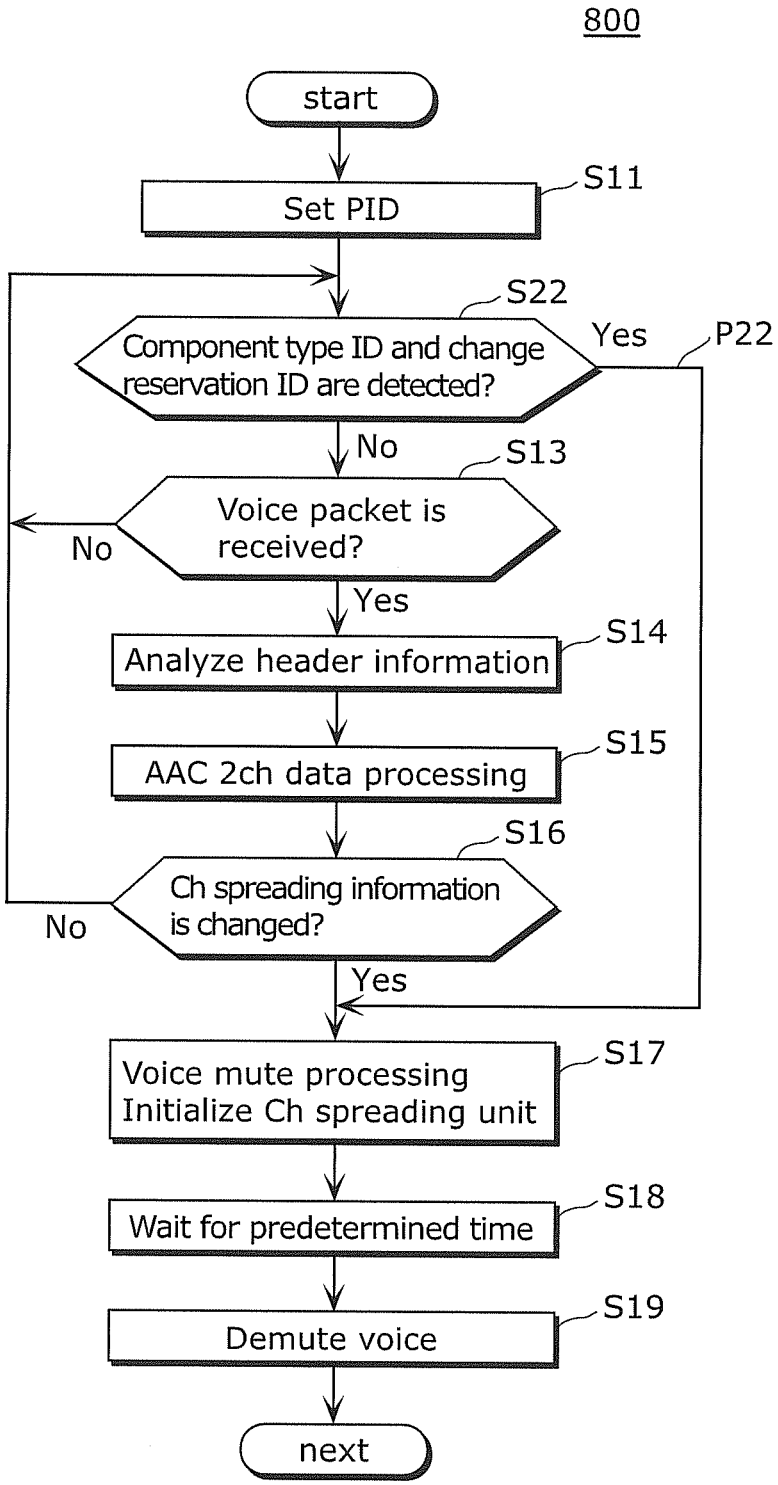
FIG. 8 illustrates an exemplary process for detecting a change in an encoding format of the voice signal and accordingly modifying the processing at the receiving device of the instant application.

FIG. 8 illustrates an exemplary process 800 for detecting a change in an encoding format of the voice signal and accordingly modifying the processing at the receiving device of the instant application. Some of the steps of process 800 are similar to those described with respect to process 2100 shown in FIG. 21. Therefore, for the sake of brevity, these steps are not described here in more detail. A point that is different from the process 2100 is that in the process 800 a Step S22 of performing component type ID and change reservation ID detection and determination is added. More specifically, upon detection of component type ID and the change reservation ID (Step S22, Yes), the Steps S13 to S16 are skipped and the processing proceeds directly to Step S17, where a pass P22 for performing voice mute processing and the initialization of the channel spreading unit 31 is added.

This therefore shorten a processing period which was required in the process 2100 for discrimination between the 2 channel and the MPEG surround based on a change from a result of the previous determination.

Figure 9:
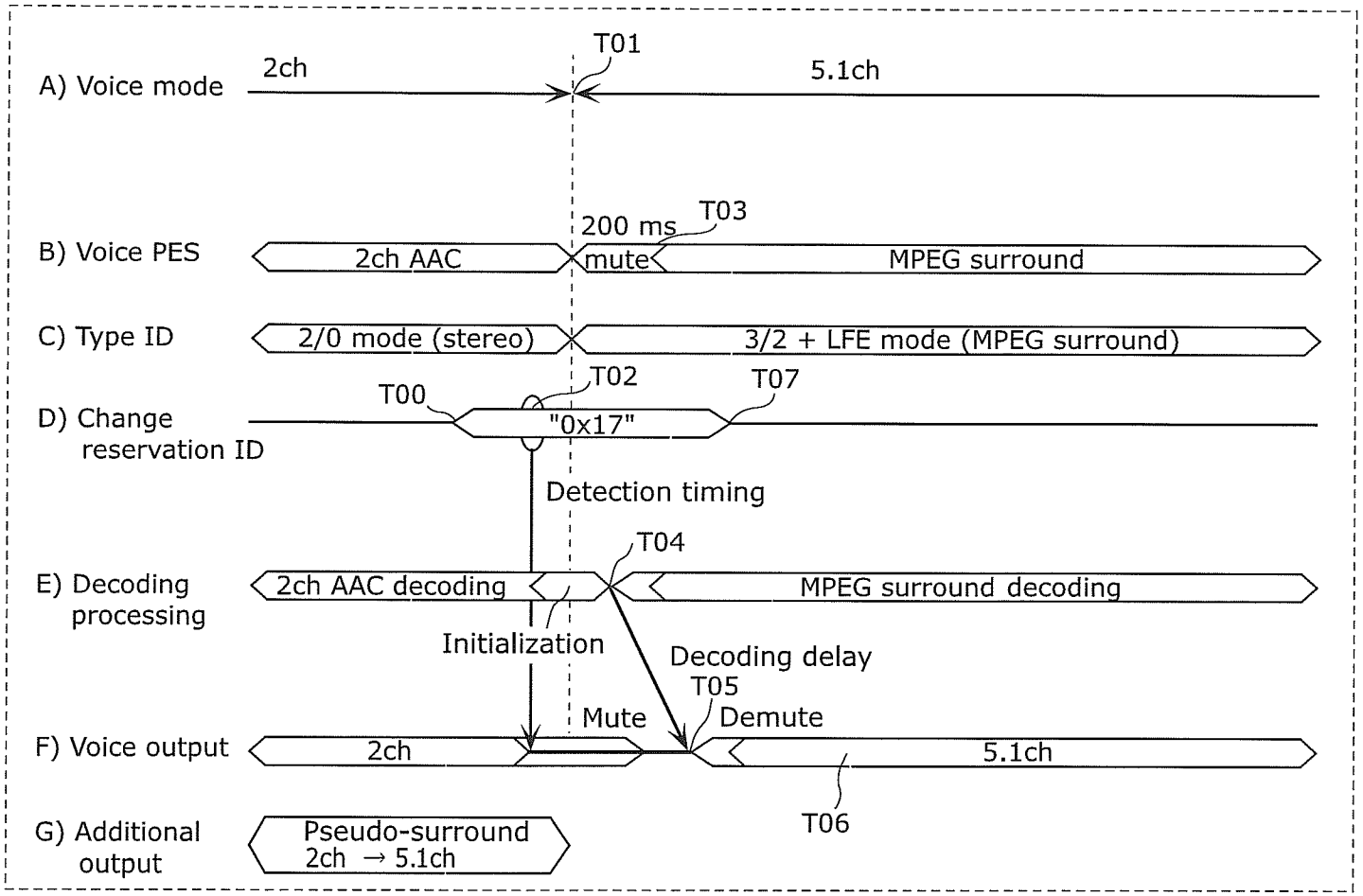
FIG. 9 illustrates an exemplary timing diagram showing time sequences for various processes in the receiving device of the instant application when the encoding format of the voice signal changes from a 2 ch to a 5.1 ch.

FIG. 9 illustrates an exemplary timing diagram 900 showing time sequences for various processes in the receiving device of the instant application when the encoding format of the voice signal changes from a 2 ch to a 5.1 ch. In FIG. 9, A) denotes a voice mode, in which switching from the 2 channel to the 5.1 channel is made at timing T01. In FIG. 9, B) denotes a voice PES delivered. As shown, data encoded by the 2-channel AAC is delivered up to timing T01 and data encoded by the MPEG surround is delivered at timing thereafter. Mute at time of switching is shortened from 500 ms to 200 ms. In FIG. 9, C) denotes a component type ID delivered. The component type ID of a 2/0 mode (stereo) is delivered up to the timing T01 and the component type ID of 3/2+LFE mode (MPEG surround) is delivered at the timing thereafter. In FIG. 9, D) denotes a change reservation ID delivered. The change reservation ID "0x17" indicates that a change of the MPEG surround is delivered from the timing TOO ahead of the timing T01, and this is repeated until T07.

In FIG. 9, E) denotes timing of decoding processing of the digital broadcast receiving device 70 that receives such the encoded voice signal from the digital broadcast transmitting device 60. Upon detecting the change reservation ID, the digital broadcast receiving device 70 recognizes a mode change at timing T02. At the same time, the digital broadcast receiving device 70 can start the initialization and can also start the decoding processing of the MPEG surround after the mode change at time T04. In FIG. 9, F) denotes a state of voice output. After passage of time required for the initialization, at the timing T05 that is after decoding processing delay from the timing T04, decoding processing data is acquired, and the mute can be released to output reproduced voice. In FIG. 9, G) denotes timing from a pseudo-surround 2 ch to the 5.1 ch as an additional output. As is the case with the channel spreading unit 31, effect of filtering and delay processing by the 5.1-channel pseudo-surround unit 20 on processing can be reduced due to the early detection of the encoding format change of the voice signal. Furthermore, the load on buffer control of the MPEG system can be reduced.

Figure 10:
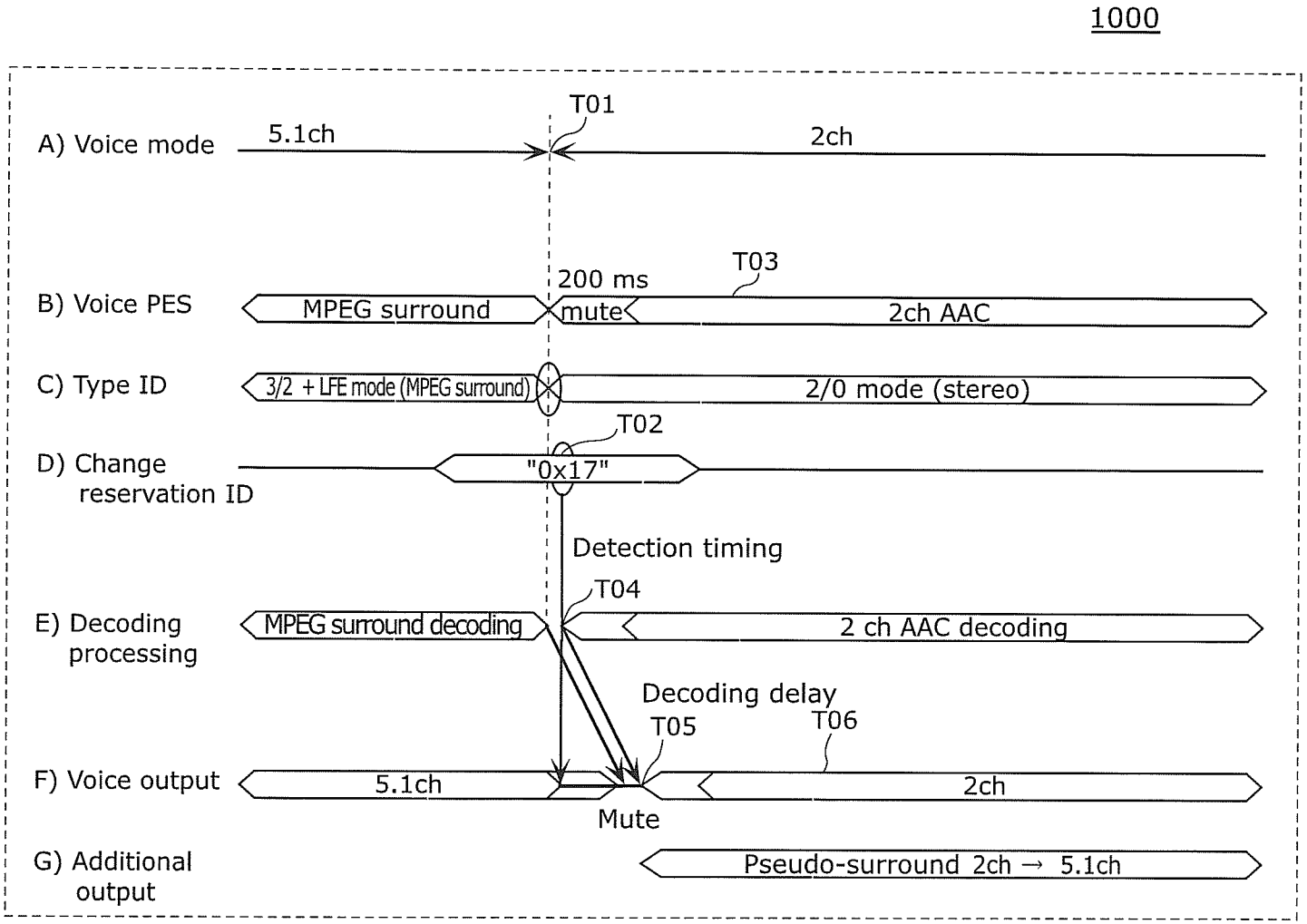
FIG. 10 illustrates an exemplary timing diagram showing time sequences for various processes in the receiving device of the instant application when the encoding format of the voice signal changes from a 5.1 ch to a 2 ch.

FIG. 10 illustrates an exemplary timing diagram 1000 showing time sequences for various processes in the receiving device of the instant application when the encoding format of the voice signal changes from a 5.1 ch to a 2 ch. The time sequences of the timing diagram 1000 are the same as those of timing diagram 900 and therefore their description will be omitted from the description. The timing diagram 1000 is different from the timing diagram 900 in that the time required for the initialization of, for example, the channel spreading unit 31 is shortened, which can further shorten the mute time.

Figure 11:
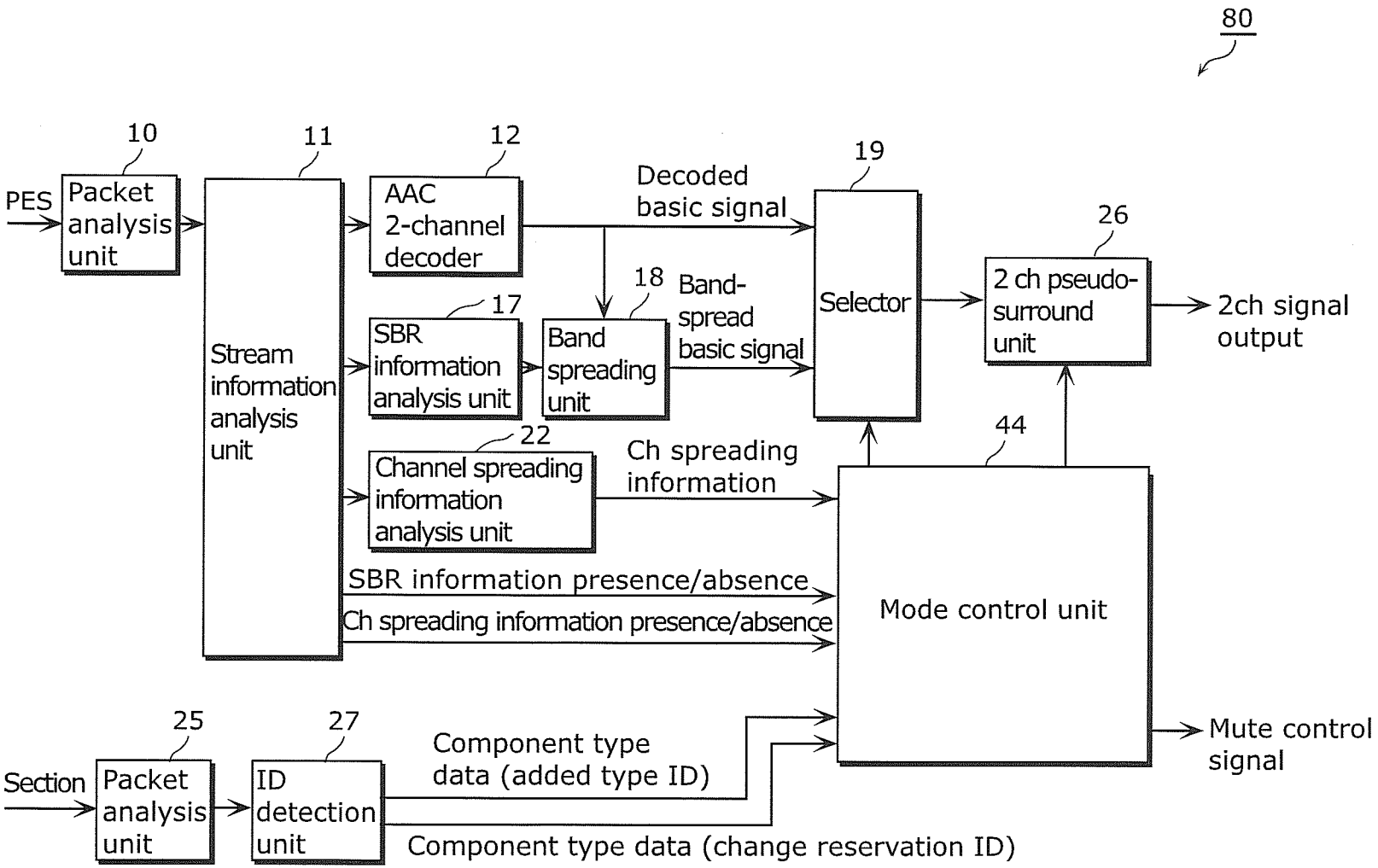
FIG. 11 illustrates an exemplary digital broadcast receiving device that reproduces a 2-channel stereo signal according to the instant application.

FIG. 11 illustrates an exemplary digital broadcast receiving device 80 that reproduces a 2-channel stereo signal according to the instant application. The digital broadcast receiving device 80 has the same basic configuration as that of the digital broadcast receiving device 70 shown in FIG. 6. However, the digital broadcast receiving device 80 does not include components related to 5.1 ch voice reproduction (the 5.1-channel pseudo-surround unit 20 and the channel spreading unit 31), but instead includes a 2-channel pseudo-surround unit 26. The 2-channel pseudo-surround unit 26 is controlled by the mode control unit 44.

Figure 12:
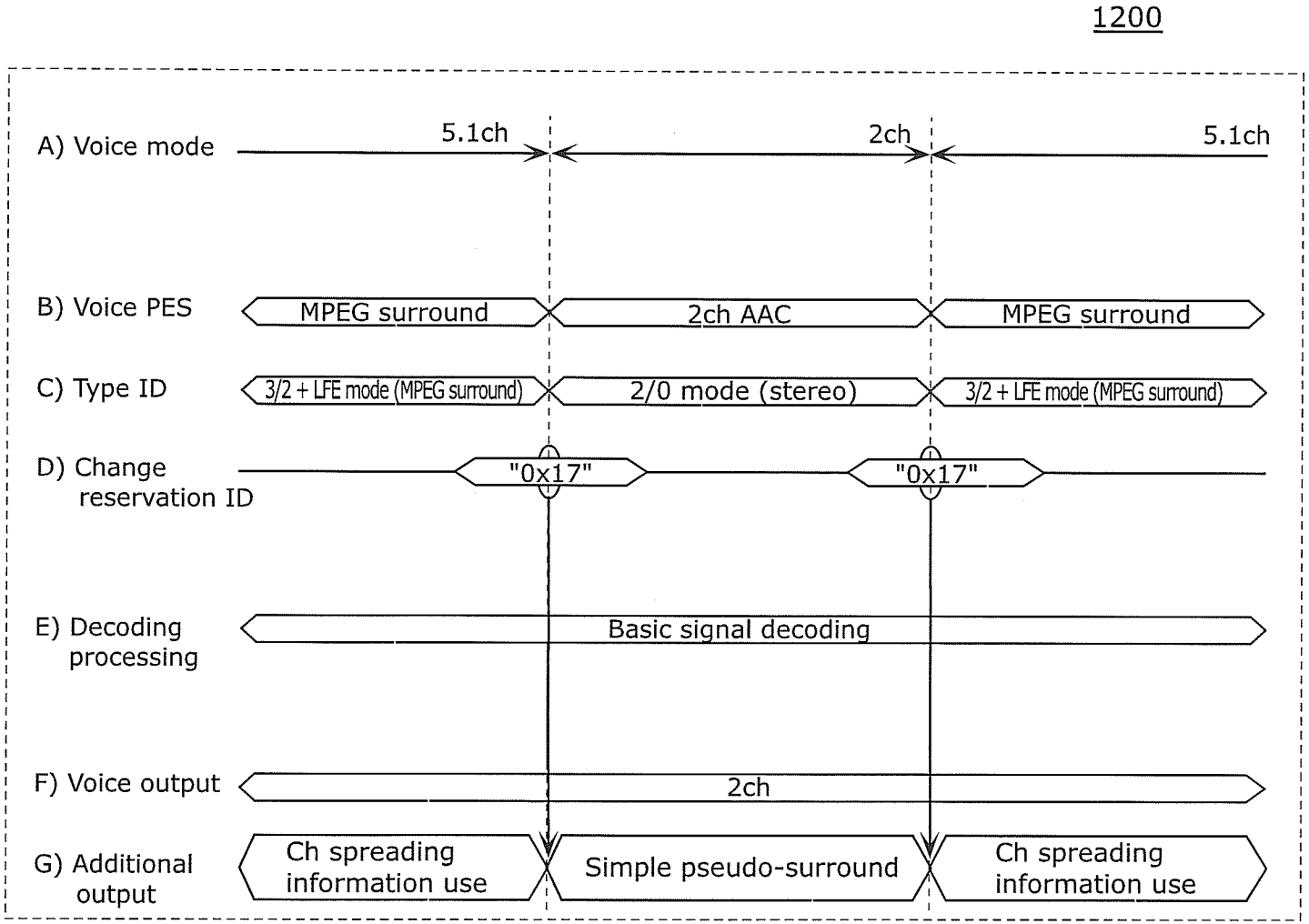
FIG. 12 illustrates an exemplary timing diagram showing time sequences for various processes in the receiving device of the instant application when the encoding format of the voice signal changes from a 5.1 ch to a 2 ch and from 2 ch to 5.1 ch.

FIG. 12 illustrates an exemplary timing diagram 1200 showing time sequences for various processes in the receiving device of the instant application when the encoding format of the voice signal changes from a 5.1 ch to a 2 ch and from 2 ch to 5.1 ch.

To this end, the instant application describes a digital broadcast transmitting device, a digital broadcast receiving device, and a digital broadcast transmitting and receiving system capable of performing processing and determination in short time in accordance with an encoding format of a transferred voice signal in a digital broadcast receiver. The instant application is suitable for a digital broadcast transfer system that digitally transfers information such as voice, a picture, or a character and also for a digital broadcast transmitting device and a digital broadcast receiving device that form the digital broadcast transfer system. The instant application is more specifically suitable for a digital broadcast receiving device such as a digital TV, a set top box, a car navigation system, or a portable one-segment TV.

Other implementations are contemplated. For example, the teachings of the instant application may be realized by a computer system including a microprocessor, a ROM (Read Only Memory), a RAM (Random Access Memory), an accumulated memory unit, a display, a man-machine interface, etc. Each device is so configured as to achieve its function through operation in accordance with a computer program stored dynamically or in a fixed manner. All or part of the components forming the devices 60, 70, and 80 described above may be formed of a system LSI. More specifically, it is a computer system so formed as to include a microprocessor, a ROM, a RAM, etc. The system LSI achieves its function by storing a computer program and operating in accordance with the computer program.

Additionally or alternatively, The teachings of the instant application may be realized by a detachable IC card or a separate module. The IC card or the module is a computer system so formed as to include a microprocessor, a ROM, a RAM, etc. It achieves its function by storing computer program and operating in accordance with the computer program.

Additionally or alternatively, the teachings of the instant application may be realized as a method including processing executed by the digital broadcast transmitting device and the digital broadcast receiving device of the instant application. Moreover, the teachings of the instant application may be realized by a computer program realizing the method by a computer, or may be realized by a digital signal including the computer program.

Additionally or alternatively, the teachings of the instant application can be realized as a recording medium in which each of these programs is recorded.

Other implementations are contemplated.

What is claimed is:

1. A digital broadcast transmitting device comprising:

a packet generation unit configured to generate packetized elementary stream (PES) data by converting an inputted voice signal into an encoded voice signal and generating a voice stream packet including the encoded voice signal;

a descriptor updating unit configured to update a component descriptor to include a component type identification (ID) and a change reservation ID, the component type ID indicating an encoding format of the encoded voice signal being an MPEG surround format and the change reservation ID indicating a change of a format of the encoded voice signal to the MPEG surround format;

a packetizing unit configured to generate section data by packetizing the component descriptor;

a multiplexing unit configured to multiplex the PES data and the section data;

a modulation unit configured to modulate and transmit multiplexed data acquired from the multiplexing unit; and a sequence control unit configured to determine a timing of the change of the format of the encoded voice signal and control the descriptor updating unit in a manner such that the change reservation ID is outputted at a time before the timing of the change of the format of the encoded voice signal.

2. The digital broadcast transmitting device according to claim 1, wherein the sequence control unit is configured to control the packet generation unit in a manner such that voice in a period during which the change reservation ID is outputted is put on mute.

3. The digital broadcast transmitting device according to claim 1, wherein the sequence control unit is configured to control the descriptor updating unit in a manner such that the descriptor updating unit outputs the change reservation ID 500 milliseconds to 1 millisecond before the timing of the change of the format of the encoded voice signal.

4. A digital broadcast transmitting and receiving system comprising:

a digital broadcast transmitting device; and a digital broadcast receiving device, wherein:

the digital broadcast transmitting device includes:

a packet generation unit configured to generate packetized elementary stream (PES) data by converting an inputted voice signal into an encoded voice signal and generating a voice stream packet including the encoded voice signal;

a descriptor updating unit configured to update a component descriptor to include a component type identification (ID) and a change reservation ID, the component type ID indicating an encoding format of the encoded voice signal being an MPEG surround format and the change reservation ID indicating a change of a format of the encoded voice signal to the MPEG surround format;

a packetizing unit configured to generate section data by packetizing the component descriptor;

a multiplexing unit configured to multiplex the PES data and the section data;

a modulation unit configured to modulate and transmit multiplexed data acquired from the multiplexing unit; and a sequence control unit configured to determine a timing of the change of the format of the encoded voice signal and control the descriptor updating unit in a manner such that the change reservation ID is outputted at a time before the timing of the change of the format of the encoded voice signal, and the digital broadcast receiving device includes:

a reception unit configured to receive the multiplexed data transmitted from the modulation unit;

a first packet analysis unit configured to acquire, from the PES data included in the multiplexed data, the voice stream packet including the encoded voice signal;

a second packet analysis unit configured to detect, from the section data included in the multiplexed data, the component descriptor including the component type ID and the change reservation ID; and a detecting unit configured to detect the change reservation ID before the change of the format of the encoded voice signal.

5. The digital broadcast transmitting and receiving system according to claim 4, wherein the sequence control unit is configured to control the packet generation unit in a manner such that voice in a period during which the change reservation ID is outputted is put on mute.

6. The digital broadcast transmitting and receiving system according to claim 4, wherein the descriptor updating unit is configured to output the change reservation ID 500 milliseconds to 1 millisecond before the timing of the change of the format of the encoded voice signal.

7. A digital broadcast transmitting method comprising steps of:

generating packetized elementary stream (PES) data by converting an inputted voice signal into an encoded voice signal and generating a voice stream packet including the encoded voice signal;

updating a component descriptor to include a component type identification (ID) and a change reservation ID, the component type ID indicating an encoding format of the encoded voice signal being an MPEG surround format and the change reservation ID indicating a change of a format of the encoded voice signal to the MPEG surround format;

generating section data by packetizing the component descriptor;

multiplexing the PES data and the section data;

modulating and transmitting multiplexed data acquired from the multiplexing step;

determining a timing of the change of the format of the encoded voice signal; and outputting the change reservation ID at a time before the timing of the change of the format of the encoded voice signal.

8. The digital broadcast transmitting method according to claim 7, further comprising a step of muting voice in a period during which the change reservation ID is outputted.

9. The digital broadcast transmitting method according to claim 7, wherein outputting the change reservation ID includes outputting the change reservation ID 500 milliseconds to 1 millisecond before the timing of the change of the format of the encoded voice signal.

10. An integrated circuit comprising:

a packet generation circuit configured to generate packetized elementary stream (PES) data by converting an inputted voice signal into an encoded voice signal and generating a voice stream packet including the encoded voice signal;

a descriptor updating circuit configured to update a component descriptor to include a component type identification (ID) and a change reservation ID, the component type ID indicating an encoding format of the encoded voice signal being an MPEG surround format and the change reservation ID indicating a change of a format of the encoded voice signal to the MPEG surround format;

a packetizing circuit configured to generate section data by packetizing the component descriptor;

a multiplexing circuit configured to multiplex the PES data and the section data;

a modulation circuit configured to modulate and transmit multiplexed data acquired from the multiplexing circuit; and a sequence control circuit configured to determine a timing of the change of the format of the encoded voice signal and control the descriptor updating circuit in a manner such that the change reservation ID is outputted at a time before the timing of the change of the format of the encoded voice signal.

* * * * *